US006597096B1

(12) United States Patent
Amano et al.

(10) Patent No.: US 6,597,096 B1
(45) Date of Patent: Jul. 22, 2003

(54) COLOR CATHODE-RAY TUBE ELECTRON GUN

(75) Inventors: Yasunobu Amano, Tokyo (JP); Norifumi Kikuchi, Kanagawa (JP); Makoto Natori, Tokyo (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 09/252,237

(22) Filed: Feb. 18, 1999

(30) Foreign Application Priority Data

Feb. 19, 1998 (JP) ..... P10-037609
Feb. 24, 1998 (JP) ..... P10-042530
Jun. 23, 1998 (JP) ..... P10-176143

(51) Int. Cl.[7] ..... H01J 29/15

(52) U.S. Cl. ..... 313/414; 313/412; 313/413; 315/368.11

(58) Field of Search ..... 313/412, 413, 313/414; 315/368.11, 368.15, 368.18, 371, 382

(56) References Cited

U.S. PATENT DOCUMENTS

| | | | | |
|---|---|---|---|---|
| 5,418,421 A | | 5/1995 | Hasegawa et al. | 313/412 |
| 5,424,619 A | * | 6/1995 | Okano et al. | 315/368.15 |
| 5,514,931 A | * | 5/1996 | Dasgupta et al. | 313/440 |
| 5,608,284 A | * | 3/1997 | Tojyou et al. | 313/412 |
| 6,031,325 A | * | 2/2000 | Amano | 313/412 |

FOREIGN PATENT DOCUMENTS

| | | | |
|---|---|---|---|
| EP | 0 234 520 | 9/1987 | H01J/29/50 |
| EP | 0 332 469 | 9/1989 | H01J/29/50 |
| EP | 0 625 791 A1 | 11/1994 | H01J/29/51 |
| EP | 899768 | 3/1999 | H01J/29/50 |
| JP | 9-228268 | 3/1999 | |
| WO | WO 91/02373 | 2/1991 | H01J/29/62 |

OTHER PUBLICATIONS

"Self Adjusting Multi–Frequency Dynamic Focus Circuit for Cathode Ray Tube Displays", vol. 38, No. 3, Mar. 1995, IBM Technical Disclosure Bulletin, pp 361–366.

* cited by examiner

*Primary Examiner*—Frank G. Font
*Assistant Examiner*—Roy M. Punnoose
(74) *Attorney, Agent, or Firm*—Rader, Fishman, & Grauer PLLC; Ronald P. Kananen, Esq.

(57) ABSTRACT

In an inline three-beam system color cathode-ray tube, there is provided an inline three-beam system color cathode-ray tube electron gun in which beam spot shapes of three electron beams on the left and right end portions of a fluorescent screen may be uniformed as much as possible and focusing voltages may be adjusted with ease and also deteriorations of beam spot shapes of three electron beams on the left and right end portions of the fluorescent screen may be alleviated and a satisfactory convergence characteristic may be obtained on the whole region of the screen.

A color cathode-ray tube electron gun includes trisected focusing electrodes. Of the trisected focusing electrodes, a voltage of a waveform similar to a sawtooth synchronized with the horizontal scanning is applied to a central focusing electrode thereof, a housed resistor is connected to the central focusing electrode and two outside focusing electrodes and a voltage which results from passing the voltage Ef3 of the waveform similar to the sawtooth through the housed resistor is applied to the two outside focusing electrodes. A color cathode-ray tube electron gun includes trisected cathodes comprising a uni-potential lens and in which a voltage of a waveform synchronized with-a horizontal direction deflection and a vertical direction deflection is applied to the center electrode of the trisected electrodes.

19 Claims, 27 Drawing Sheets

COLOR CATHODE-RAY TUBE ELECTRON GUN

BACKGROUND OF THE INVENTION

1. Field of the Invention

The present invention relates to an inline three-beam system color cathode-ray tube electron gun for use with a color cathode-ray tube comprising a color picture tube, a color display device or the like.

2. Description of the Related Art

At present, as the demand for a high-resolution color cathode-ray tube increases, a problem concerning the spot shape of the electron beam at, in particular, a peripheral surface of the screen becomes significant.

Also, a problem occurs in which a difference occurs in focusing voltages among three electron beams at, in particular, the peripheral surface of the screen so that satisfactory spot shapes of the three electron beams cannot be obtained at the same time.

This causes a phenomenon in which red characters become unclear on the right-had side of the screen and blue characters become unclear on the left-hand side of the screen in a display monitor.

In order to solve such problems, there is proposed a color cathode-ray tube electron gun which houses a so-called quadrupole lens.

FIG. 1 shows a diagram of a conventional color cathode-ray tube electron gun housing a quadrupole lens.

This electron gun 70 includes three cathodes $K_R$, $K_G$, $K_B$ which are parallely arrayed in an inline-fashion. From the cathodes K ($K_R$, $K_G$, $K_B$) to the anode side, there are coaxially disposed a first electrode 11, a second electrode 12, a third electrode 13, a fourth electrode 14, a fifth electrode 51, 52, a sixth electrode 16 and a shield cap 17, in that order. Then, the fifth electrode is divided by half to provide a first sub-electrode 51 and a second sub-electrode 52. Also, the second electrode 12 and the fourth electrode 14 are connected electrically.

In this color cathode-ray tube electron gun 70, a constant first focusing voltage Ef1 is applied through a stem portion to the third electrode 13 and the sub-electrode 51.

On the other hand, a second focusing voltage Ef2 in which a waveform voltage of a parabolic waveform synchronized with a horizontal deflection is superimposed upon the first focusing voltage Ef1, is applied to the other sub-electrode 52.

Thus, a quadrupole lens (not shows) is formed between the first sub-electrode 51 and the second sub-electrode 52. In addition, this quadrupole lens cases a change of intensity to occur in a focusing lens formed between the sub-electrode 52 and the sixth electrode 16.

As a result, shapes of electron beams at the left and right peripheral portions of the fluorescent screen may be made satisfactory.

Also, FIG. 1 shows the electron gun of a QPF (Quadra Potential Focus) type. The following is also true in bipotential type electron gun without the fourth electrode 14 and a unipotential type electron gun.

Subsequently, FIG. 2 shows a schematic diagram of a color cathode-ray tube.

As shown in FIG. 2, three electron beams R, G, B are emitted from an electron gun 1 and impinge upon the left-hand side of the screen 4 and the right-hand side of the screen at peripheral portions of the fluorescent screen 4. Because these three beams are respectively placed at different positions in a magnetic field of a deflection yoke 2, the directions and intensities of the magnetic field applied to the three electron beams are different.

Accordingly, the distorted states of electron beam spots at the left and right peripheral portions of the fluorescent screen 4 become different in the three electron beams R, G, B. Incidentally, reference number 3 in the figure denotes a glass bulb. Also, "right-hand side of screen" and "left-hand side of screen" mean the right-hand side and the left-hand side obtained when the fluorescent screen 4 of the color cathode-ray tube is observed from the outside, respectively.

In general, the focusing voltage or the like is set in such a manner that the spot shape of the center electron beam G of the three electron beams R, G, B becomes optimum.

In this case, when the three electron beams R, G, B impinge upon the right-hand side of the fluorescent screen 4, the red electron beam R passes a relatively outer side of a deflection magnetic field formed by the deflection yoke 2 as compared with the electron beams G and B, and is strongly affected by the deflection magnetic field. As a result, the distortion of the beam spot of the electron beam R on the fluorescent screen 4 becomes larger than that of the other electron beams G, B.

On the other hand, when the three electron beams R, G, B impinge upon the left-hand side of the fluorescent screen 4, the blue electron beam B passes a relatively outer side of the deflection magnetic field formed by the deflection yoke 2 as compared with the electron beams G and R, and is strongly affected by the deflection magnetic field. As a result, the distortion of the beam spot of the electron beam B on the fluorescent screen 4 becomes larger than that of the other electron beams R, G.

Accordingly, in a display monitor, in particular, a large color display monitor having a high resolution, phenomenon, red characters become unclear on the right-hand side screen and blue characters become unclear on the left-hand side screen as mentioned before.

This phenomenon may be expresses such that the respective focusing voltages of the three electron beams R, G, B differ from each other on the peripheral portions of the screen.

For this reason, as a means for solving this problem, there was previously proposed a color cathode-ray tube electron gun for applying lens effects of different intensities to a red electron beam R and a blue electron beam B (see Japanese patent application No. 9-228268, Japanese patent application No. 9-313940, etc.).

FIG. 3 shows an example of an electrode layout of the previously-proposed color cathode-ray tube electron gun mentioned above.

This electron gun 50 includes three cathodes $K_R$, $K_G$, $K_B$ that are parallelly arrayed in an inline-fashion. From the cathodes K ($K_R$, $K_G$, $K_B$) to the anode side, there are coaxially disposed a first electrode 11, a second electrode 12, a third electrode 13, a fourth electrode 14, a fifth electrode 51, 52, a sixth electrode 16 and a shield cap 17, in that order. The second electrode 12 and the fourth electrode 14 are electrically connected.

The fifth electrode corresponding to a focusing electrode is halved to provide a first sub-electrode 51 and a second sub-electrode 52. Further, the first sub-electrode 51 is trisected to provide a 5-1Ath electrode 51A, a 5-1Bth electrode 51B and a 5-1Cth electrode 51C.

The 5-1Ath electrode 51A, the 5-1Bth electrode 51B and the 5-1Cth electrode 51C constitute a first quadrupole lens. Also, the 5-1Cth electrode 51C and the 5-2th electrode 52 constitute a second quadrupole lens. Then, the quadrupole lens action of the second quadrupole lens is controlled by the first quadrupole lens.

A fixed focusing voltage Ef1 is applied to the third electrode 13 and the 5-1Ath electrode 51A and the 5-1Cth electrode 51C disposed outside the trisected electrode 51. A third focusing voltage Ef3, in which a waveform voltage (see FIG. 4) of a shape similar to a sawtooth synchronized with a horizontal deflection and the fixed focusing voltage Ef1 are superimposed upon each other, is applied to the 5-1Bth electrode 51B. Also, a second focusing voltage Ef2, in which a waveform voltage (see FIG. 4) of a parabolic shape synchronized with the horizontal deflection and the fixed focusing voltage Ef1 are superimposed upon each other, is applied to the electrode 52.

These three focusing voltages EF1, Ef2, Ef3 are generally applied from a stem portion of the tip end of the electron gun 50.

Incidentally, the waveform of the third focusing voltage Ef3 may be a waveform which linearly changes in the form similar to a sawtooth shown in FIG. 5A or a waveform of a sine wave shape which intermittently occurs once per period of a horizontal deflection period shown in FIG. 5B.

Three electron beam passing apertures are bored through the 5-1Ath electrode 51A, the 5-1Bth electrode 51B, the 5-1Cth electrode 51C, respectively.

In the previously-proposed color cathode-ray tube electron gun described above, by devising the shapes of the electron beam passing apertures of the respective electrodes 51A, 51B, 51C the deflection magnetic fields applied to the three electron beams R, G, B may be independently controlled at the respective electron beams. By independently controlling the deflecting magnetic field, so that differences in the converging effect on the electron beams may be canceled out, three electron beams of satisfactory shapes may be simultaneously obtained at the peripheral portions of the screen, thereby eliminating the phenomenon in which a focusing of red color is deteriorated on the right-hand side of the screen and a focusing of blue color is deteriorated on the left-hand side of the screen.

As a method of devising the shapes of the electron beam passing apertures, there are enumerated the following methods.

1. In the respective electrodes 51A, 51B, 51C, the passing aperture o one outside electron beam (e.g. red R) and the passing aperture of the other outside electron beam (e.g. blue B) are formed as astigmatism shapes different from each other, and the passing apertures of the two outside electron beams (e.g. red R and blue B) of the opposing electrodes are formed as astigmatism shapes different from each other (see FIGS. 12 and 13).

2. In the respective electrodes 51A, 51B, 51C, the passing aperture of one outside electron beam is formed as a large diameter, the passing aperture of the other outside electron beam is formed as a small diameter, and one of the passing apertures the two outside electron beams of the opposing electrodes is formed as a large diameter and the other is formed as a small diameter (see FIGS. 14 and 15).

3. In the respective electrodes 51A, 51B, 51C, a thickness around a passing aperture of one outside electron beam is made large, a thickness around a passing aperture of the other outside electron beam is made thin, a thicknesses around one of the passing apertures of the two outside electron beams of the opposing electrodes is made thick and the other is made thin (see FIGS. 16 and 17).

4. In the above-mentioned arrangement 1, further, by restricting the aspect ratio of the astigmatism shape of the electron beam passing aperture, an influence exerted upon the center electron beam (e.g. green G) may be removed so that a shielding body need not be provided for the center electron beam (see FIGS. 18 and 19).

By adopting the above-mentioned methods, it is possible to independently control the deflection magnetic fields applied to the three electron beams R, G, B at the respective electron beams.

However, according to the above-mentioned methods, if the three kinds of the focusing voltages, i.e. the fixed focusing voltage Ef1, the parabolic-shaped waveform voltage Ef2 and the sawtooth-shaped waveform voltage Ef3 are not adjusted independently, it's the effect would not be demonstrated sufficiently.

Therefore, as compared with the case in which the two kinds of the focusing voltages Ef1, Ef2 are adjusted like the conventional electron gun shown in FIG. 1, the adjustment process becomes complicated.

The deterioration of the focusing of the red electron beam R and the blue electron beam B at the peripheral portion f the screen is caused by the deflection magnetic field and is separated into a quadrupole lens component and a convergence lens component.

Then, the previously-proposed electron gun mentioned above is able to correct only the quadrupole lens component or to correct only the convergence lens component. Moreover, the above-mentioned electron gun is weak in sensitivity and affects a lens intensity of the other portion. Thus, a complete correction effect cannot be obtained in actual practice.

Therefore, there is required a lens structure having a sufficient correction sensitivity and which may correct both the quadrupole lens component and the convergence lens component of the distortion.

FIG. 6 shows a schematic arrangement of another a conventional display inline-type electron gun.

This electron gun 60 includes three cathodes $K_R$, $K_G$, $K_B$ that are parallelly arrayed in an inline fashion. From the cathodes K ($K_R$, $K_G$, $K_B$) to the anode side, there are coaxially disposed a first electrode 11, a second electrode 12, a third electrode 13, a fourth electrode 14, a fifth electrode 51, 52, a sixth electrode 16 and a shield cap 17 in that order.

Also, the second electrode 12 and the fourth electrode 14 are connected electrically.

Then, the third electrode 13 and the fifth electrode 51, 52 are convergence electrodes (hereinafter referred to as focusing electrodes), and held at potentials ranging from 4kV to 10kV.

Also, the sixth electrode is an acceleration electrode, and held at a potential ranging from 20kV to 30kV.

A pre-focus lens is arranged between the cathodes K and the third electrode 13, a first convergence lens (focus lens) is arranged between the third electrode 13 and the fifth electrode 51, 52, and a main convergence lens is arranged between the fifth electrode and the sixth electrode 16.

Then, the third electrode 13 is divided to provide a first sub-electrode 13A and a second sub-electrode 13B, and the fifth electrode is divided by half to provide a first sub-electrode 51 and a second sub-electrode 52.

In this color cathode-ray tube electron gun 60, a constant first focus voltage Ef1 is applied through a stem portion to the electrode 13A on the anode side of the third electrode 13 and the electrode 51.

On the other hand, a second focus voltage Ef2 having a waveform shown in FIG. 7 is applied to the electrode 13B on the anode side of the third electrode 13 and the electrode 52.

This second focus voltage Ef2 has a waveform in which a parabolic waveform synchronized with the horizontal deflection, so-called downwardly-convexed parabolic waveform, is superimposed upon a parabolic-shaped background Eg1 synchronized with a vertical deflection and which becomes a high voltage in a screen corner (corner portion of the screen) and which becomes a low voltage at the center of the screen. Incidentally, the amplitude of this second focusing voltage Ef2 is almost constant.

Thus, variable quadrupole lenses (not shown) are respectively formed between the electrode 13A and the electrode 13B and between the electrode 52 and the electrode 52. In addition, these quadruple lenses cause the change of intensity to occur in a focusing lens (not shown) formed between the electrode 52 and the sixth electrode 16.

As a result, the shapes of the electron beams on the left and right peripheral portions of the fluorescent screen may be made satisfactory.

As already shown in FIG. 2, three electron beams R, G, B emitted from an electron gun 1, which impinge upon the peripheral portions (e.g., the right-hand side and the left-hand side) of the fluorescent screen 4, experience magnetic fields whose directions and intensities are different because the three electron beams are respectively placed at different positions within the magnetic field of a deflection yoke 2.

Accordingly, the distorted states of the electron beam spots on the left and right peripheral portions of the fluorescent screen 4 become different in the three electron beams R, G, B. In FIG. 2, reference numeral 3 designates a glass bulb. Also, "right-hand side" and "left-hand side" respectively mean the right-hand side and the left-hand side obtained when the fluorescent screen 4 of the color cathode-ray tube is observed from the outside.

In general, the inline-type color cathode-ray tube electron gun 1 is not provided with a mechanism for adjusting convergence of the three electron beams R, G, B on the whole region of the screen and the convergence is adjusted by the deflection yoke 2.

However, recently, there is an increasing demand for such convergence. Also, as resolution becomes high, frequency also increases. Therefore, the conventional convergence adjustment method has difficulty meeting the market's requirements.

For example, one method of adjusting convergence disposes an electromagnetic coil (so-called neck assembly and coil) on the electron gun side of the deflection Yoke. However, as frequency becomes high, due to the phenomenon of an eddy current which occurs against a deflection magnetic field or the like, a phase difference occurs between a convergence adjustment voltage waveform and the actual scanning so that the voltage waveform has difficulty following the actual scanning. Consequently, a convergence adjustment is difficult such as when a displacement occurs between a desired place to be adjusted and a place that is adjusted in actual practice or the like.

Also, in order to satisfy the high requirements of convergence, the designing of the deflection yoke becomes complicated and a magnetic field arrangement becomes complex with the result that shapes of electron beams on the peripheral portions of the screen tend to be distorted, thereby resulting in focusing characteristics being deteriorated.

In general, in the deflection yoke, when a deflection distortion which causes the shape of the electron beam to be deteriorated is decreased, a magnetic field distribution becomes uniform so that the red electron beam R and the blue electron beam B become coincident with each other on the center of the screen. However, a mis-convergence in a horizontal direction shown in FIG. 8A and a mis-convergence in a vertical direction shown in FIG. 8B occur in the peripheral portions of the screen, thereby resulting in the red electron beam R and the blue electron beam B being displaced from each other.

SUMMARY OF THE INVENTION

In order to solve the above-mentioned problems, according to the present invention, in an inline three-beam system color cathode-ray tube, there is provided an inline three-beam systemcolor cathode-ray tube electron gun in which beam spot shapes of three electron beams on left and right end portions of a fluorescent screen may be uniform as much as possible and in which focusing voltages may be adjust with ease.

Also, according to the present invention, in an inline three-beam system color cathode-ray tube, there is provided an inline three-beam system color cathode-ray tube electron gun in which both of a quadrupole lens component and a convergence lens component causing the deterioration of the focusing of the electron beam may be corrected and in which beam spot shapes of three electron beams on the left and right end portions of the fluorescent screen may be uniform as much as possible.

In order to solve the above-mentioned problem, in an inline three-beam system color cathode-ray tube, the present invention includes providing an inline three-beam system color cathode-ray tube electron bun in which the deteriorations of beam spot shapes of the three electron beams on the left and right end portions of the fluorescent screen may be reduced and a satisfactory convergence characteristic may be obtained on the whole region of the screen.

In a color cathode-ray tube electron gun according to the present invention, with trisected focusing electrodes, a voltage of a waveform similar to a sawtooth synchronized with a horizontal scanning is applied to a center focusing electrode, a housed resistor is connected to the center focusing electrode and two outside focusing electrodes, and a voltage which results from passing the voltage of the waveform similar to the sawtooth through the housed resistor is applied to the two outside focusing electrodes.

According to the above-mentioned arrangement of the present invention, because the voltage applied to the two outside electrodes is the voltage which results from passing the voltage of the waveform similar to the sawtooth through the housed resistor and this voltage becomes a voltage of a waveform close to that of a constant voltage, it is possible to obtain effects similar to those obtained when a fixed focusing voltage is applied to the two outside focusing electrodes.

A color cathode-ray tube electron gun according to the present invention may include trisected electrodes, a fixed voltage applied to two outside electrodes of the trisected electrode and, a voltage of a waveform similar to a sawtooth synchronized with the horizontal scanning applied to a center electrode. The center electrode and one outside electrode of the trisected electrodes form a quadrupole lens, and the center electrode and the other outside electrode of the trisected electrodes form a convergence lens./

According to the above-mentioned arrangement of the present invention, because the fixed voltage is applied to the two outside electrodes of the trisected electrodes and the voltage of the waveform similar to the sawtooth synchronized with the horizontal scanning is applied to the center electrode, respectively, the shapes of the electron beams on the peripheral portions of the screen may be made satisfactory.

Further, since the center electrode and one outside electrode form the quadrupole lens and the center electrode and the other electrode form the convergence lens, it is possible to correct both of the quadrupole lens action component and the convergence lens action component of the lens action generated by the deflection magnetic field.

In a color cathode-ray tube electron gun according to the present invention, a voltage of a waveform synchronized with a horizontal direction deflection and a vertical direction deflection is applied to a center electrode of the trisected electrodes comprising a uni-potential lens.

According to the above-mentioned arrangement of the present invention, since the voltage of the waveform synchronized with the horizontal direction deflection and the vertical direction deflection is applied to the center electrode of the trisected electrodes, it is possible to adjust the convergence in the horizontal direction or the vertical direction.

BRIEF DESCRIPTION OF THE EMBODIMENTS

FIGS. 16A to 16C are diagrams showing a third embodiment of shapes of the sub-electrodes of the electron bun of FIG. 9;

DESCRIPTION OF THE PREFERRED EMBODIMENTS

Figure 1:
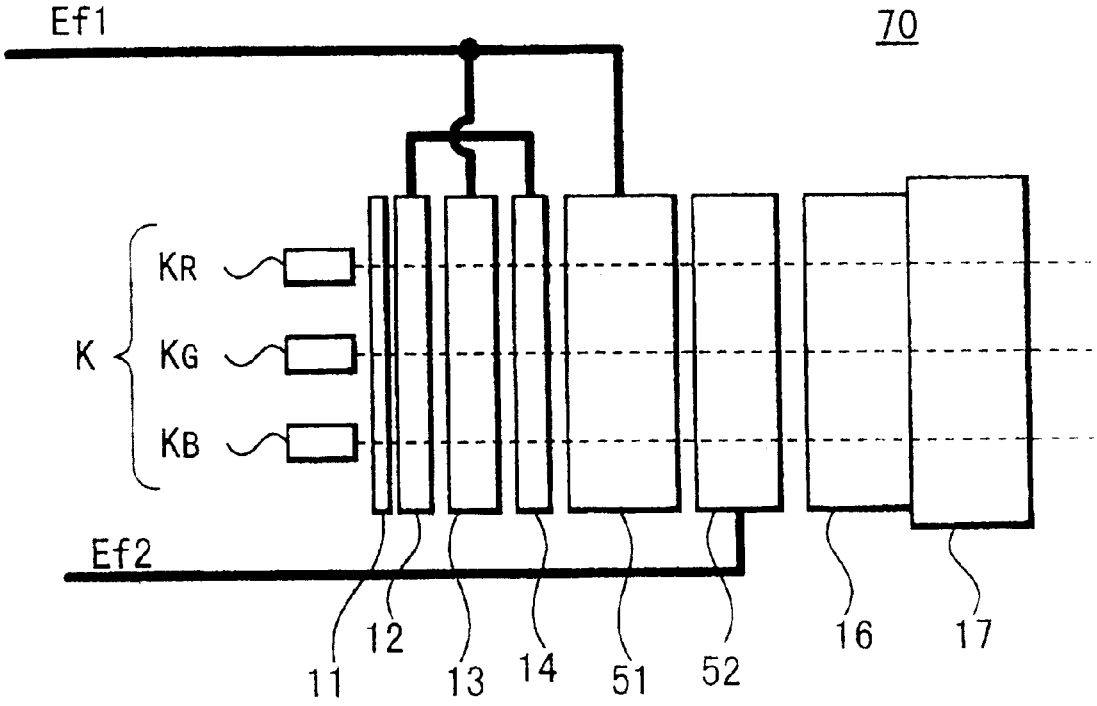
FIG. 1 PRIOR ART
FIG. 1 is a schematic diagram of an arrangement of an example of a conventional color cathode-ray tube electron gun housing a quadrupole lens.

According to the present invention, there is provided a color cathode-ray tube electron gun which comprises trisected focusing electrodes. Within the trisected focusing electrodes, a voltage of a waveform similar to a sawtooth synchronized with a horizontal scanning is applied to its center focusing electrode, a housed resistor is connected to the center focusing electrode and two outside focusing electrodes, and a voltage which results from passing the voltage of the waveform similar to the sawtooth through the housed resistor is applied to the two outside focusing electrodes.

Also, according to the present invention, the color cathode-ray tube electron gun further includes a second focusing electrode provided independently of the trisected focusing electrodes and wherein a voltage of a waveform similar to a parabolic shape synchronized with a horizontal scanning is applied to the second focusing electrode.

Also, according to the present invention, in the color cathode-ray tube electron gun, in the trisected focusing electrodes, one of the elctron beam passing apertures, through which outside electron beams of the three electron beams pass, is formed with a horizontally-oblong astigmatism shape in the divided opposing focusing electrodes and the another passing aperture is formed with a vertically-oblong astigmatism shape in the other focusing electrode, and within the same focusing electrode, one passing aperture through which the outside electron beam passes is formed with horizontally-oblong astigmatism shape and the other passing aperture through which the outside electron beam passes is formed with a vertically-oblong astigmatism shape.

Also, according to the present invention, in the color cathode-ray tube electron gun of the trisected focusing electrodes, one of the passing apertures through which outside electron beams of the three electron beams pass is made large in diameter and the other is made small in diameter in the divided opposing focusing electrodes, and, within the same focusing electrode, one of the passing apertures through which outside electron beams pass is made large in diameter and the other passing aperture through which the outside electron beams pass is made small in diameter.

Also, according to the present invention, in the color cathode-ray tube electron gun of the trisected focusing electrodes, one of the electrodes surrounding passing apertures through which outside electron beams of the three electron beams pass is made thick and the other is made thin in the divided opposing electrodes, and one of the electrodes surrounding passing apertures through which the outside electron beams pass is made thick and the surround portion of the other passing aperture through which the outside electron beam pass is made thin within the same focusing-electrode.

Also, according to the present invention, in the color cathode-ray tube electron gun, the voltage of the sawtooth waveform decreases in the direction from the position of red color to the position of blue color on a fluorescent screen of a cathode-ray tube.

According to the present invention, there is provided a color cathode-ray tube electron gun which comprises trisected electrodes and, of the trisected electrodes and a fixed voltage is applied to two outside electrodes, a voltage of a waveform similar to a sawtooth synchronized with the horizontal scanning is applied to a center electrode. The center electrode and one outsideelectrode of the trisected electrodes form a quadrupole lens, and the center electrode and the other outside electrode of the trisected electrodes form a convergence lens.

Also, according to the present invention, in the color cathode-ray tube electron gun of the trisected focusing electrodes, in the center electrode and one outside electrode forming a quadrupole lens, one of the passing apertures through which outside electron beams of three electron beams pass is formed with a horizontally-oblong astigmatism shape in the divided opposing focusing electrodes and the other is formed with a vertically-oblong astigmatism shape in the other focusing electrode, and within the same focusing electrode, one passing aperture through which the outside electron beam passes is formed with horizontally-oblong astigmatism shape and the other passing aperture through which the outside electron beam passes is formed as a vertically-oblong astigmatism shape.

Also, according to the present invention, in the color cathode-ray tube electron bun, of the trisected focusing electrodes, in the center electrode and other outside electrode forming a convergence lens, one of the passing apertures through which outside electron beams of three electron beams pass is made large in diameter and the other is made small in diameter in the divided opposing focusing electrodes, and, within the same electrode, one of the passing apertures through which outside electron beams pass is made large in diameter and the other passing aperture through which the outside electron beams pass is made small in diameter.

Also, according to the present invention, in the color cathode-ray tube electron gun of the trisected focusing electrodes, in the center electrode and other outside electrode forming the convergence lens, one of the electrodes surrounding the passing apertures through which outside electron beams of the three electron beams pass is made thick and the other is made thin in the divided opposing electrodes, and one of the electrodes surrounding the passing apertures through which the outside electron beams pass is made thick and the surrounding portion of other passing aperture through which the outside electron beams pass is made thin within the same focusing electrode.

Figure 9:
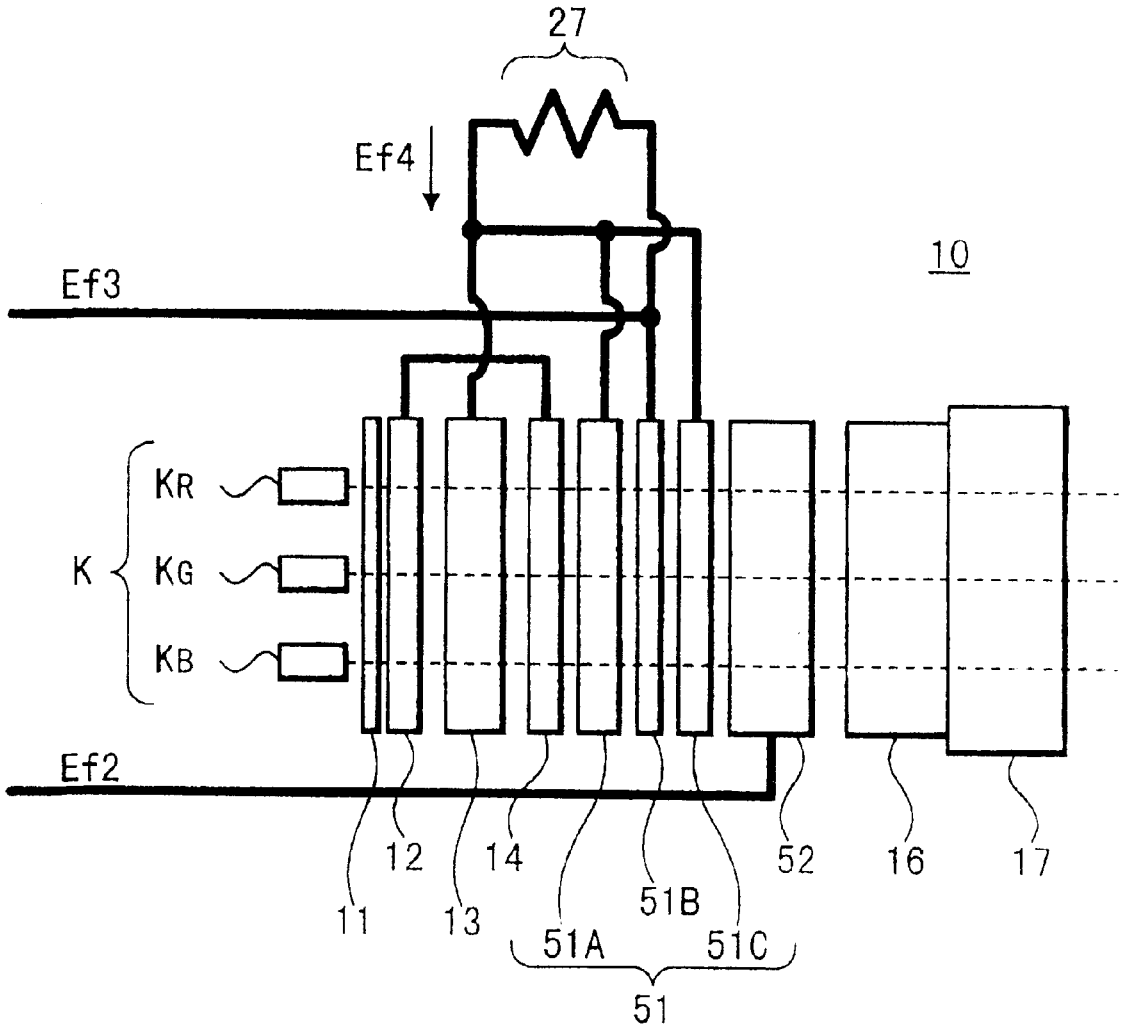
FIG. 9 is a schematic diagram showing an electrode layout of an electron gun according to an embodiment of the present invention.

FIG. 9 shows an electrode layout of a color cathode-ray tube electron gun according to an embodiment of the present invention.

The color cathode-ray tube electron gun according to this embodiment includes trisected focusing electrodes. In the trisected focusing electrodes, a voltage of a waveform similar to that of a sawtooth synchronized with the horizontal scanning is applied to the center focusing electrode, and the center focusing electrode and two outside focusing electrodes are connected through a housed resistor.

This electron gun 10 includes three cathodes $K_R$, $K_G$, $K_B$ that are parallelly arrayed in an inline-fashion. From the cathodes K ($K_R$, $K_G$, $K_B$) to the anode side, there are coaxially disposed a first electrode 11, a second electrode 12, a third electrode 13, a fourth electrode 14, a fifth electrode 51, 52, a sixth electrode 16 and a shield cap 17 in that order. The second electrode 12 and the fourth electrode 14 are electrically connected to each other.

Then, the fifth electrode corresponding to the focusing electrode is halved to provide a 5-1th electrode 51 and a 5-2th electrode 52. Further, the 5-1th electrode 51 is trisected to provide a 5-1Ath electrode 51A, a 5-1Bth electrode 51B and a 5-1Cth electrode 51C.

Accordingly, the focusing electrode (fifth electrode) is divided by four, and the 5-1Ath electrode 51A, the 5-1Bth electrode 51B and the 5-1Cth electrode 51C constitute a first quadrupole lens. Also, the 5-1Cth electrode 51C and the 5-2th electrode 52 constitute a second quadrupole lens. the quadrupole lens action of the second quadrupole lens is controlled by the first quadrupole lens.

A voltage of 0V (or several tens of Volts), for example, is applied to the first electrode 11, a voltage ranging from 200 to 800V, for example, is applied to the second electrode 12 and the fourth electrode 14, and an anode voltage ranging fro 22kV to 3OkV, for example, is applied to the sixth electrode 16.

Then, a third focusing voltage (i.e. voltage in which the fixed-focusing voltage and a waveform voltage of a shape similar to a sawtooth synchronized with the horizontal deflection are superimposed upon each other similarly as described before) Ef3 (see FIG. 10) is applied to the center 5-1Bth electrode 51B of the trisected 5-1th electrode 51.

Also, a second focusing voltage (i.e. voltage in which the fixed focusing voltage and the waveform voltage of the parabolic shaped synchronized with the horizontal deflection are superimposed upon each other similarly as described above) Ef2 (see FIG. 10) which is a waveform voltage of a parabolic shape synchronized with the horizontal deflection is applied to the 5-2th electrode 52.

In this embodiment, further, the third electrode 13 and the two outside electrodes, namely the 5-1Ath electrode 51A AND 5-Cth electrode 51C of the trisected 5-1th electrodes 51, are connected commonly. These commonly-connected electrodes 13, 51A and 51C are connected through a housed resistor 27 to the 5-1Bth electrode 51B. To these electrodes 13, 51A, 51C is applied a fourth focusing voltage Ef4 which results from processing the third focusing voltage Ef3 by a low-pass filter action through the housed resistor 27.

Figure 2:
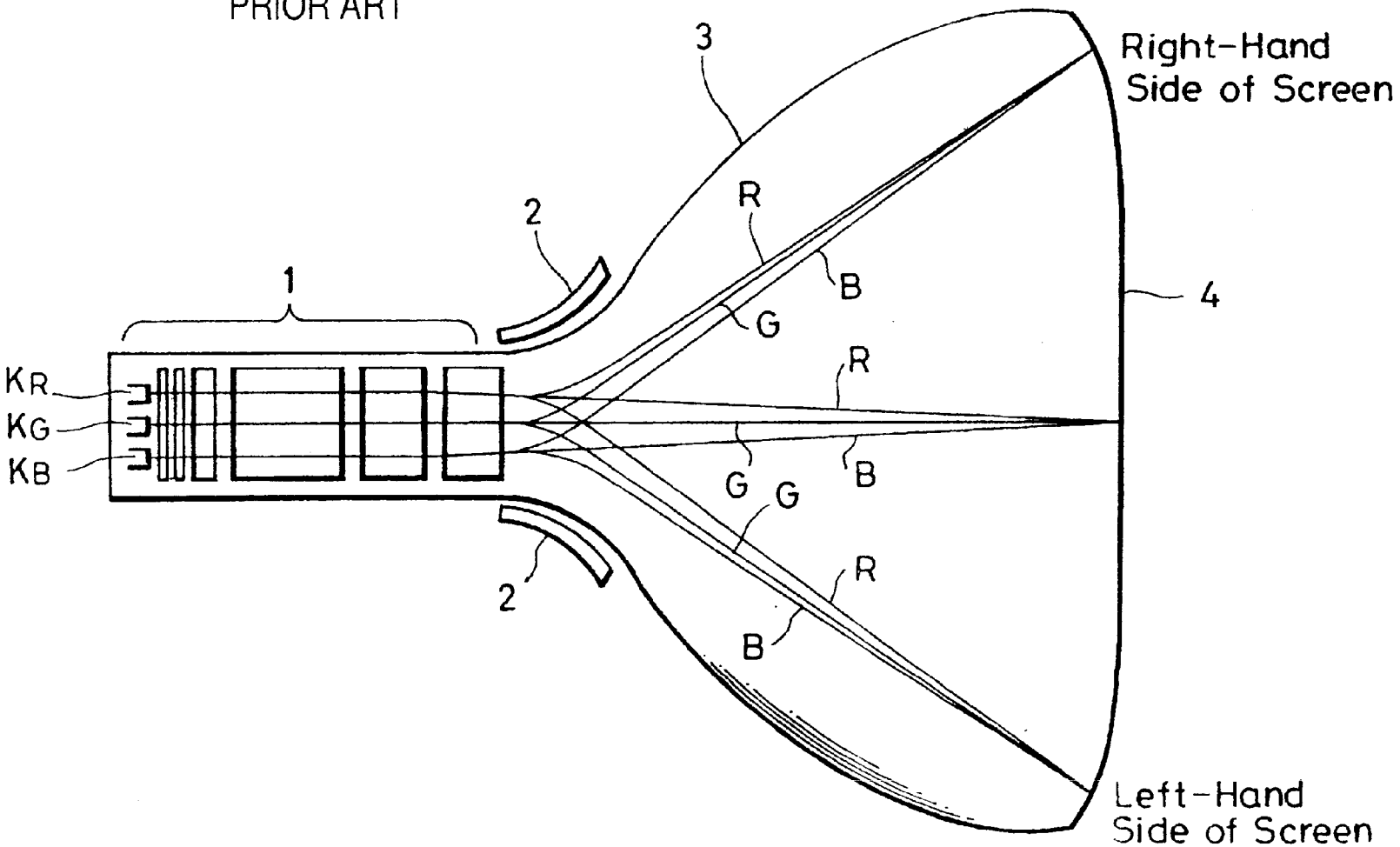
FIG. 2 PRIOR ART
FIG. 2 is a schematic diagram of a color cathode-ray tube.
Figure 3:
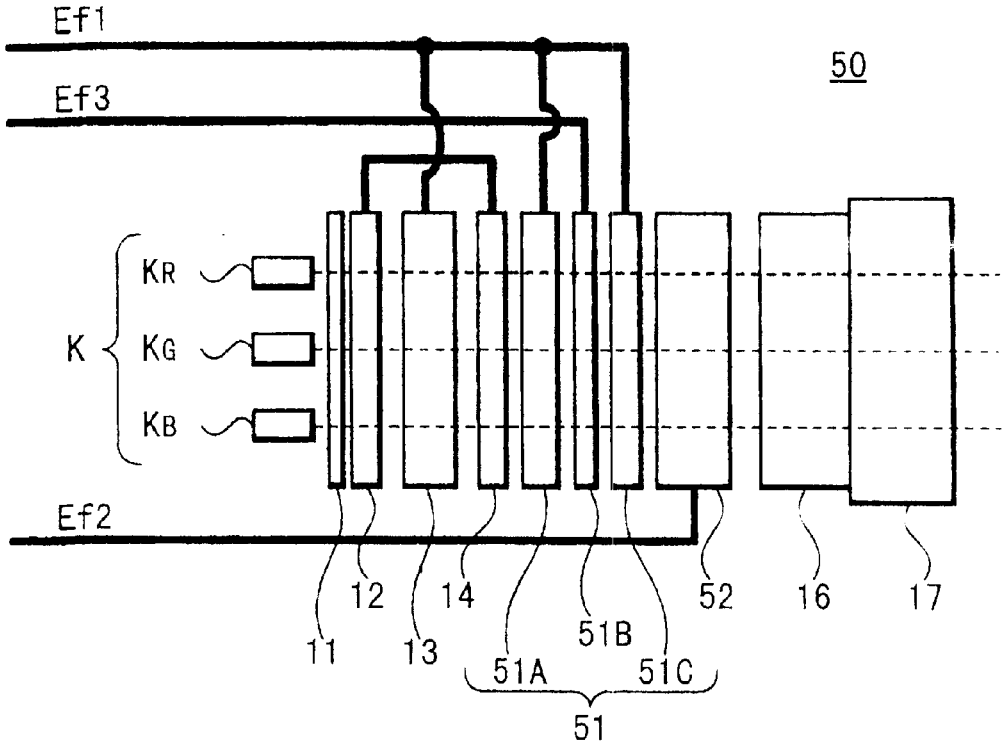
FIG. 3 PRIOR ART
FIG. 3 is a schematic diagram of an arrangement of a previously-proposed color cathode-ray tube electron gun.

The fourth focusing voltage Ef4 becomes a waveform voltage close to the conventional fixed focusing voltage Ef1 shown in FIG.2 because the third focusing voltage Ef3 of the shape similar to the sawtooth is processed by the low-pass filter effect of the housed resistor 27.

Then, owing to a potential difference between the fourth focusing voltage Ef4 and the third focusing voltage Ef3, this electron gun becomes able to operate similarly to the previously-proposed color cathode-ray tube electron gun, and shapes of the three electron beams may be made satisfactory at the same time.

According to the above-mentioned embodiment, the focusing voltages supplied from the outside may be limited to the second focusing voltage Ef2 and the third focusing voltage Ef3.

Also, the housed resistor 27 is formed of a suitable resistor such as a thick-film resistor having a resistance value ranging from several 10s of MΩ to several 1000s of MΩ, for example, although the resistance value is changed depending upon a frequency band in which a color cathode-ray tube is in use or the like.

A method of using a housed resistor as a low-pass filter is described in Japanese Patent No. 2645061, etc. for example. According to this method, in an arrangement comprising dynamic quadrupole and focusing electrodes, the housed resistor is used only to convert two kinds of focusing voltages, i.e. a parabolic-like waveform voltage and a fixed voltage into one voltage but is unable to make the shapes of the three electron beams satisfactory at the same time.

Incidentally, the second focusing voltage Ef2 that is applied to the 5-2th electrode 52 may be supplied to the third electrode 13.

In the case of the above-mentioned embodiment, although focusing effect of the dynamic quadrupole effect formed by the 5-1Cth electrode 51C, the 5-2th electrode 52 and the sixth electrode 16 become asymmetric on the left-hand side and the right-hand side of the screen, a value of a potential difference, which is the cause of such asymmetry on the left-hand side and the right-hand side of the screen, between the fourth focusing voltage Ef4 and the second focusing voltage Ef2 is small, and hence may be safely neglected.

Incidentally, the amplitudes of the waveforms of the respective focusing voltages are such that the fourth focusing voltage Ef4 is several 10s of Volts, the second focusing voltage Ef2 is about 100V and the third focusing voltage Ef3 is about 500V, for example.

As another embodiment, in order to improve a resolution, there is a method of aggressively using the potential difference between the fourth focusing voltage Ef4 and the second focusing voltage Ef2 and which causes the dynamic quadrupole and the focusing effect to become asymmetric.

In general, when the fluorescent screen 4 of the color cathode-ray tube comprises the red color R, the green color G, the blue color B in that order from left to right, the focusing of the red color R is deteriorated on the right-hand side of the screen and the focusing of the blue color B is deteriorated on the left-hand side of the screen as mentioned before. To be more accurate, the deterioration of the red color R on the right-hand side of the screen is significant.

This is caused by the following two reasons:

1. Since the current amount of the red electron beam is larger than that of the blue electron beam, its original size is larger. For example, the current ratio is such that red color:green color:blue color=1.1:1:0.9

2. Since a luminosity factor of a red color is larger than that of a blue color, the deterioration of the red color is noticeable.

Figure 10:
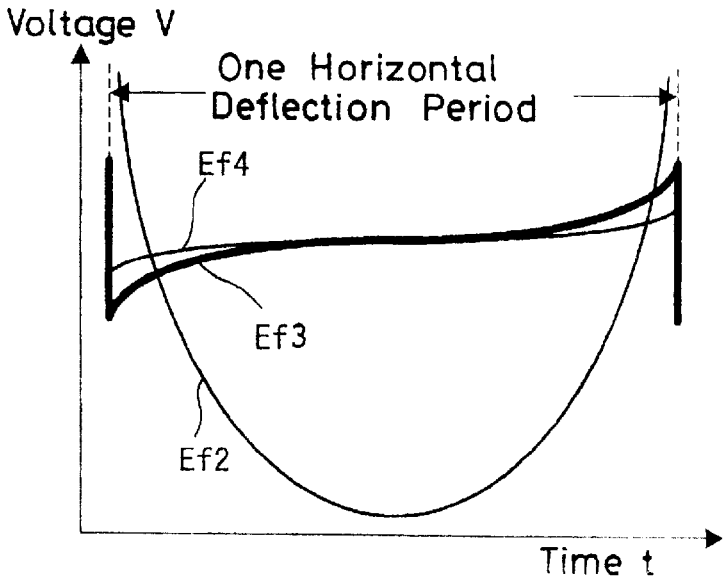
FIG. 10 is a diagram showing a mode of a waveform of a focusing voltage used in the electron gun of FIG. 9.
Figure 11:
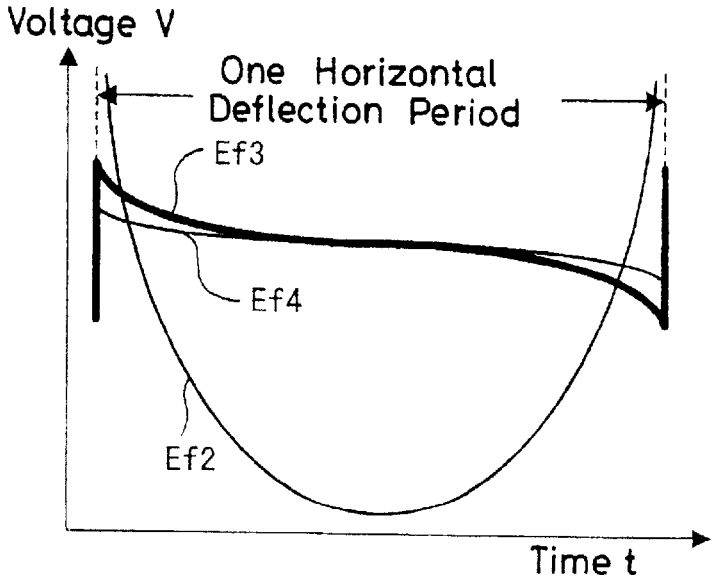
FIG. 11 is a diagram showing another mode of a waveform of a focusing voltage used in the electron gun of FIG. 9.

Accordingly, if the focusing voltage is converted into a waveform voltage of a shape similar to a sawtooth waveform which rises, as shown in FIG. 11, on the high voltage side at the beginning of one horizontal deflection period and the voltage is progressively lowered contrary to the waveform shown in FIG. 10, for example, the focusing of the red color R on the right-hand side of the screen may be improved and the focusing of the blue color B on the left-hand side of the screen may be deteriorated, thereby making it possible to balance the resolution on the whole.

In the color cathode-ray tube electron gun according to the above-mentioned embodiment, the 5-1th electrode, i.e. the 5-1Ath electrode 51A, the 5-1Bth electrode 51B, the 5-1Cth electrode 51C may be shaped in such a manner that the three electron beams R, G, B may be controlled independently like the aforementioned previously-proposed electron gun.

FIGS. 12 to 19 show embodiments of the respective 5-1th electrodes 51A, 51B, 51C and the shapes of their electron beam passing apertures.

Figure 12A:
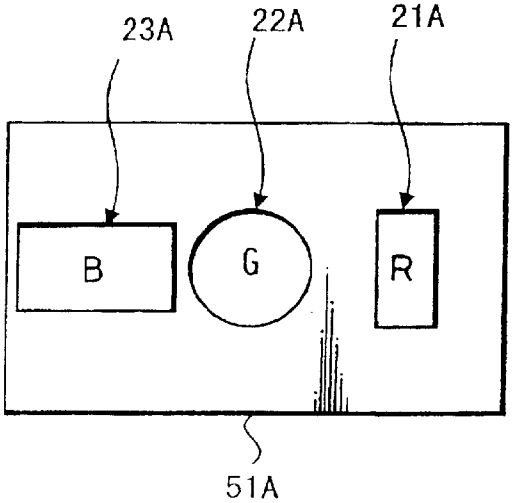
FIGS. 12A to 12C are diagrams showing a first embodiment of shapes of sub-electrodes of the electron gun of FIG. 9.
Figure 12B:
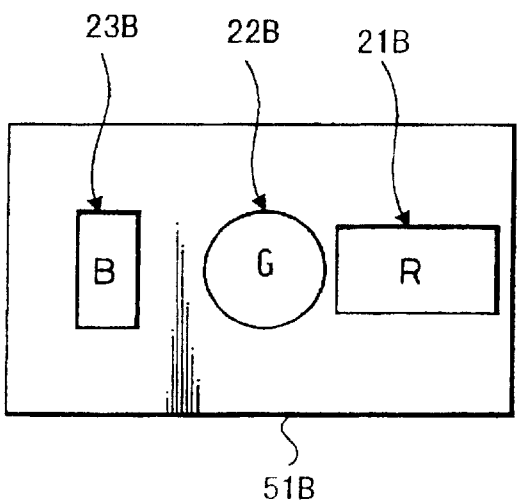
Figure 12C:
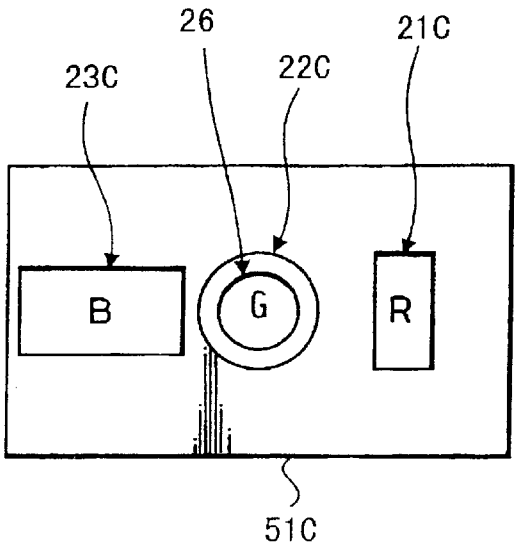
Figure 13B:
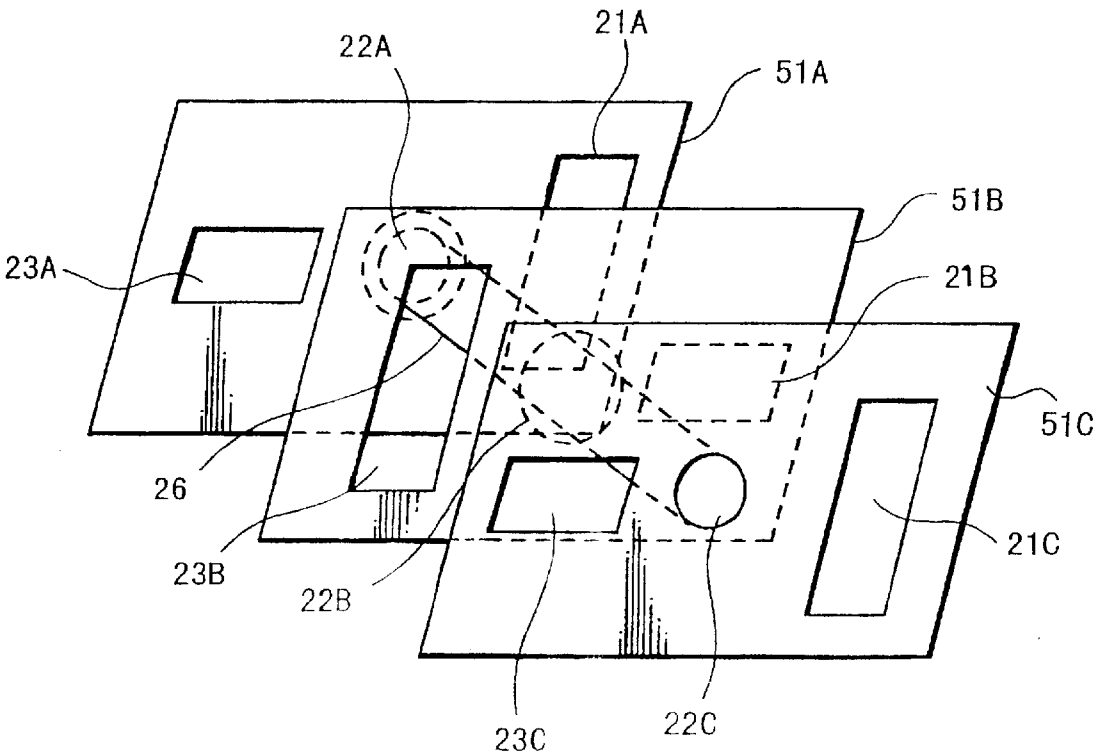
FIGS. 13A and 13B are diagrams showing a positional relationship of the sub-electrodes in the embodiment of FIG. 12.
Figure 13A:
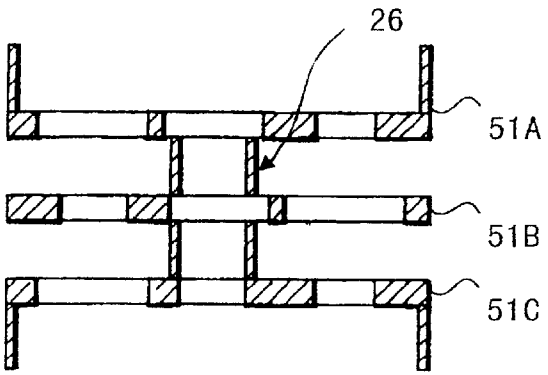

Initially, as a first embodiment, FIG. 12 shows a schematic diagram of an example of electron beam passing apertures of the trisected respective 5-1th electrodes 51 (51A, 51B, 51C), FIG. 13A shows a cross-sectional view of the trisected 5-1th electrodes 51 taken along the horizontal plane, and FIG. 13B is a schematic perspective view of the states in which passing apertures corresponding three beams are disposed, respectively.

As shown in FIGS. 12 and 13, on the opposing surfaces of the respective 5-1th electrodes 51A, 51B, 51C, electron beam passing apertures 21A, 21B, 21C (electron beam R passes in this embodiment) bored on one end side thereof are formed as astigmatic shapes, i.e. longitudinally-oblong or horizontally-oblong shapes different from those of the electron beam passing apertures 23A, 23B, 23C (electron beam B passes in this embodiment).

Further, electron beam passing apertures bored on the respective ends of the respective 5-1th electrodes 51A, 51B, 51C are formed as astigmatic shapes different from those of the electron beam passing apertures bored on the surfaces of the opposing 5-1th electrodes.

To be concrete, the electron beam passing apertures 21A, 23A bored on the respective end sides of the 5-1Ath electrode 51A are formed as astigmatism shapes different from those of the electron beam passing apertures 21B, 23B formed on both side of the opposing 5-1Bth electrode 51B, and the electron beam passing apertures 21B, 23B bored on the respective end sides of the 5-1Bth electrode 51B are formed as astigmatism shapes different from those of the electron beam passing apertures 21C, 23C bored on both end sides of the opposing 5-1Cth electrode 51C.

Specifically, the electron beam passing apertures 21A, 21C (electron beam R passes in this embodiment) bored on one end sides of the two outside 5-1Ath electrode 51A and 5-1Cth electrode 51C are formed as vertically-oblong astigmatism shapes, the electron beam passing apertures 22A, 22C (electron beam G passes in this embodiment) bored on the center are circular, and the electron beam passing apertures 23A, 23C (electron beam B pasess in this embodiment) bored on the other end sides are formed as horizontally-oblong astigmatism shapes. On the other hand, the electron beam passing aperture 21B (electron beam R passes in this embodiment) bored on one side of the center 5-1Bth electrode 51B is formed as a horizontally-oblong astigmatism shape, the electron beam passing aperture 22B (electron beam G passes in this embodiment) bored at the center is circular, and the electron beam passing aperture 23B (electron beam B passes in this embodiment) bored on the other end side is formed as a vertically-oblong astigmatism shape.

In the case of FIGS. 12 and 13, the red electron beam R which passes at a relatively outside portion of the deflection magnetic field to the right-hand side of the screen passes the electron beam passing apertures of the vertically-oblong, horizontally-oblong and vertically-oblong astigmaticshapes to that a convergence lens effect occurs in the quadrupole lens of the divided 5-1th electrodes 51 on the right-hand side of the screen, thereby strengthening a convergence lens effect.

Conversely, the blue electron beam B which passes at a relatively inside portion of the deflection magnetic field on the right-hand side of the screen passes the electron beam passing apertures of the horizontally-oblong, vertically-oblong and horizontally-oblong astigmatic shapes so that a divergence lens effect occurs in the quadrupole lens of the divided 5-1th electrodes 51 on the right-hand side of the screen, thereby a convergence lens effect is weakened.

At that time, the center green electron beam G is not affected by the third focusing voltage Ef3 of the waveform similar to the sawtooth because the electron beam passing aperture 22B of the center 5-1Bth electrode 51B of the divided 5-1th electrodes 51 is shielded by a shielding body 26 protruded from the 5-1Cth electrode 51C.

Since the passing apertures through which the three electron beams R, G, B pass in the respective 5-1th electrodes 51A, 51B, 51C are formed as described above, differences of electron beam convergence actions exerted upon the two outside electron beams R, B by the deflection magnetic field may be canceled out so that the three electron beams R, G, B may be formed as the same satisfactory shapes.

Figure 14A:
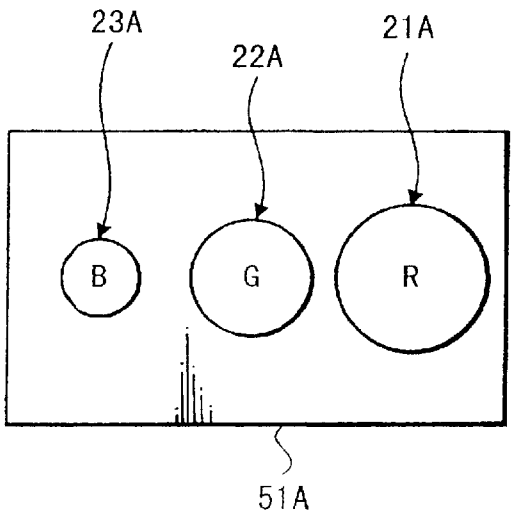
FIGS. 14A to 14C are diagram showing a second embodiment of shapes of the sub-electrodes of the electron gun of FIG. 9.
Figure 14B:
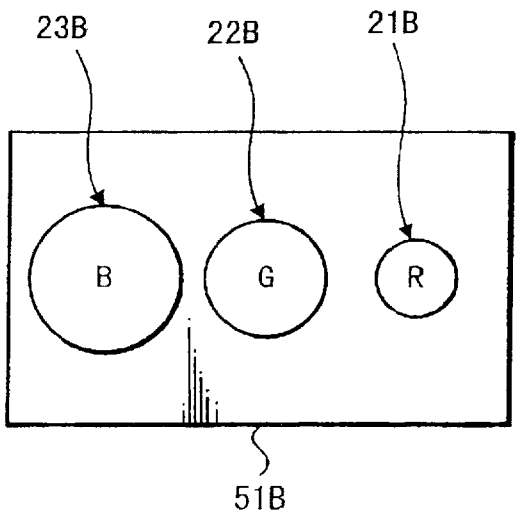
Figure 14C:
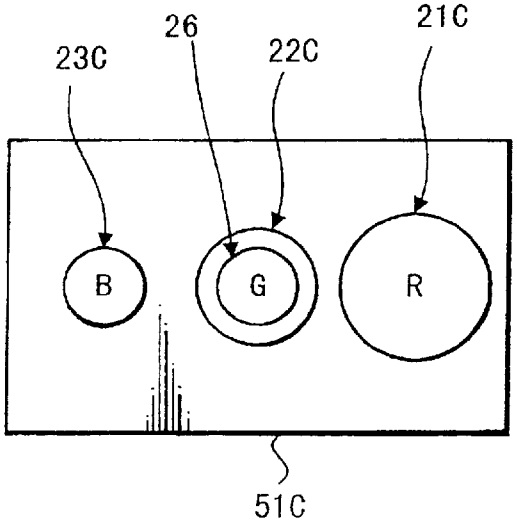
Figure 15B:
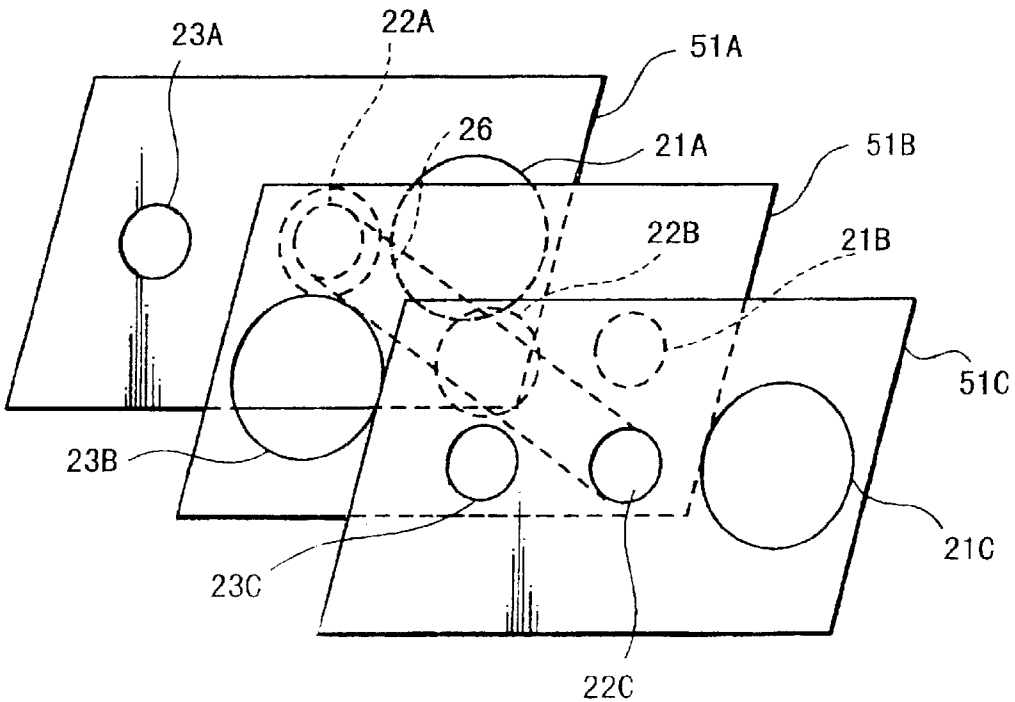
FIGS. 15A and 15B are diagrams showing a positional relationship of the sub-electrode in the embodiment of FIG. 14.
Figure 15A:
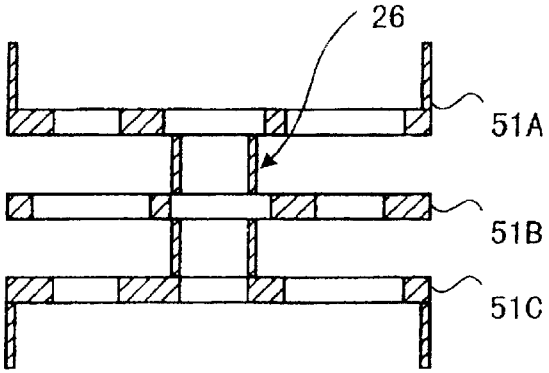

Then, as a second embodiment, FIG. 14 shows a schematic diagram of an example of electron beam passing apertures of the respective trisected 5-1th electrodes 51 (51A, 51B, 51C), FIG. 15A shows a cross-sectional view of the trisected 5-1th electrodes 51 taken along the horizontal plane, and FIG> 15B shows a schematic perspective view of the states in which passing apertures corresponding to the three electron beams are disposed, respectively.

As shown in FIGS. 14 and 15, on the opposing surfaces of the respective 5-1th electrodes 51A, 51B, 51C, the electron beam passing apertures 21A, 21B, 21C. (electron beam B passes in this embodiment) are bored on sides opposite to the electron beam passing apertures 23A, 23B, 23C (electron beam B passes in this embodiment) which are bored on the other ends of the electrodes.

Further, the electron beam passing apertures bored on the respective end sides of the respective 5-1th electrodes 51A, 51B, 51C are opposite to the electron beam passing apertures bored on the surfaces of the opposing 5-1th electrodes in diameter of electron beam passing aperture. One is large in diameter, and the other is small in diameter.

To be concrete, the electron beam passing apertures 21A, 23A bored on the respective end sides of the 5-1Ath electrode 51A re different in diameter from the electron beam passing apertures 21B, 23B bored the respective ends of the opposing 5-1Bth electrode 51B in diameter, and the electron beam passing apertures 21B, 23B bored on the respective end sides of the 5-1Bth electrode portion 51B are different from the electron beam passing apertures 21C, 23C bored on the respective end sides of the opposing 5-1Cth electrode 51C in diameter.

Specifically, the electron beam passing apertures 21A, 21C, (electron beam R passes in this embodiment) bored on one end sides of the two outsides 5-1Ath electrode 51A and 5-1Cth electrode 51C are large in diameter, the electron beam passing apertures 22A, 22C, (electron beam G passes in this full embodiment) bored at the center are intermediate in diameter, and the electron beam passing apertures 23A, 23C (electron beam B in the embodiment) bored on the outer end sides are small in diameter. On the other hand, the electron beam passing aperture 21B (electron beam R passes in this embodiment) bored on one side of the center 5-1th electrode 51B is small in diameter, the electron beam passing aperture 22B (electron beam G passes in this embodiment) bored at the center is intermediate in diameter, and the electron beam passing aperture 23B (electron beam passes in the embodiment) bored on the other end side is large in diameter.

In the case of FIGS. 14 and 15, the red electron beam R which passes at a relatively outside portion of the deflection magnetic field on the right-hand side of the screen passes the electron beam passing aperture of large, small and large diameters so that a convergence lens effect occurs in the focusing lenses of the divided 5-1th electrodes 51 on the right-hand side of the screen, thereby resulting in a convergence lens effect being strengthened.

Conversely, the blue electron beam B which passes at a relatively inside portion of the deflection magnetic field on the right-hand side of the screen passes the electron beam passing apertures of small, large and small diameters so that a divergence lens effect occurs in the divided 5-1th electrodes on the right-hand side of the screen, thereby resulting in a convergence lens effect which is weakened.

At the time, the center green electron beam G is not affected by the third focusing voltage Ef3 of the waveform similar to the sawtooth because the electron beam passing aperture 22B of the center 5-1Bth electrode 51B of the divided 5-1th electrodes 51 is shielded by the shield body 26 protruded from the 5-1Cth electrode 51C.

Since the passing apertures through which the three electron beams R, G, B pass in the respective 5-1th electrodes 51A, 51B, 51C, are formed as described above, similarly to the first embodiment, differences of electron beam convergence action exerted upon the two outside electron beams R, B by the deflection magnetic field may be canceled out so that the three electron beam R, G, B may be formed as the same satisfactory shapes.

Figure 16A:
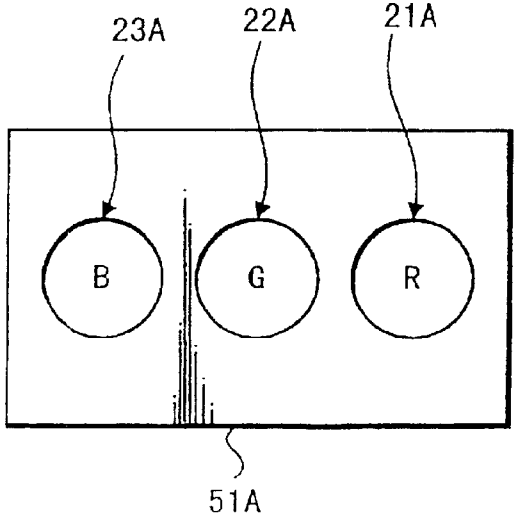
Figure 16B:
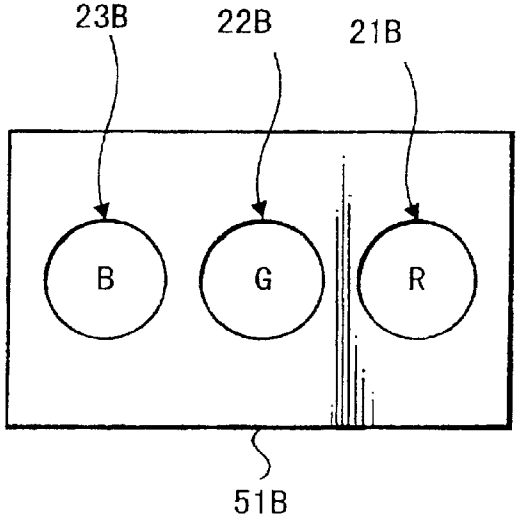
Figure 16B:
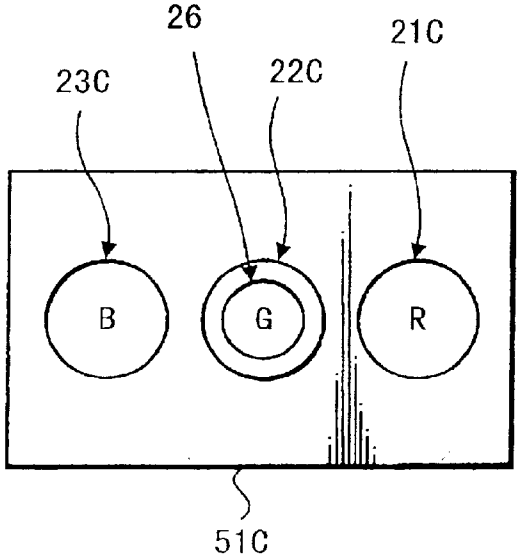
Figure 17B:
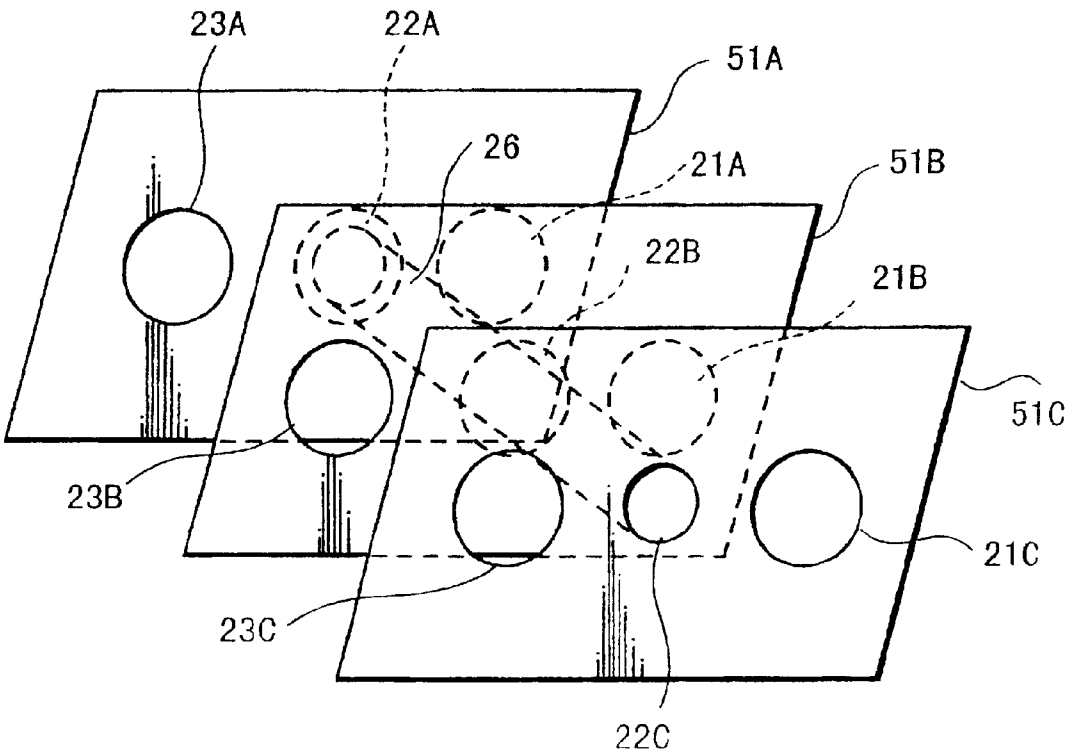
FIGS. 17A and 17B are diagrams showing a positional relationship of the sub-electrodes in the embodiment of FIG. 16.
Figure 17A:
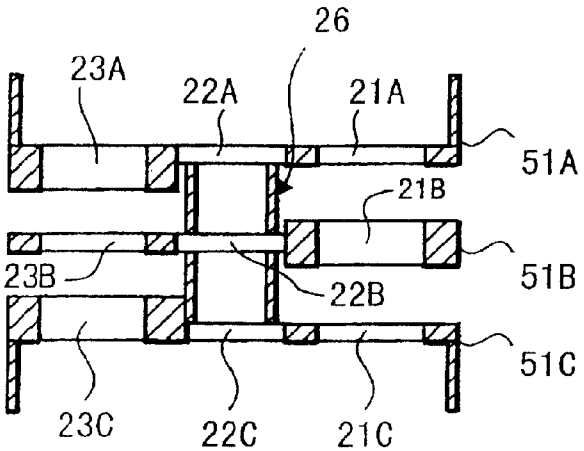

Then, as a third embodiment, FIG. 16 shows a schematic diagram of an example of shape of electron beam passing apertures of the respective focusing electrode portions 51A, 51B, 51C. FIG. 17A shows a cross-sectional view of the trisected 5-1th electrodes 51 (51A, 51B, 51C) taken along the horizontal plane, and FIG. 17B shows a schematic perspective view of the states in which passing apertures corresponding to the three electron beams are disposed, respectively.

Incidentally, FIGS. 16 and 17 show the case in which a cylindrical shield body 26 is provided in the passing apertures through which the center electron beam G passes.

The shapes of the respective electron beam passing apertures are circular shapes with the same diameter as shown in FIG. 16.

Then, as shown on FIG. 17, on the opposing surfaces of the respective 5-1th electrodes 51A, 51B, 51C, the electron beam passing apertures 21A, 21B, 21C (electron beam R passes in this embodiment) bored on one end sides are different from the electron beam passing apertures 23A, 23B, 23C (electron beam B passes in this embodiment) bored on the other end sides in plate thickness of the electrode surrounding the electron beam passing aperture.

Further, the surrounding portion of the electron beam passing aperture bored on the respective end side of the respective 5-1th electrodes 51A, 51B, 51C have plate thickness different from those of the surrounding portions of the electron beam passing apertures bored on the opposing surfaces of the 5-1th electrodes.

To be concrete, the surrounding portions of the electron beam passing apertures 21A, 23A bored on the respective end sides of the 5-1th electrode 51A are different in plate thickness from the surrounding portions of the electron beam passing apertures 21B, 23B bored on both sides of the opposing 5-1Bth electrode 51B. The surrounding portion of the electron beam passing apertures 21B, 23B bored on the respective end sides of the 5-1Bth electrode portion 51B are different in plate thickness from the surrounding portions of the electron beam passing apertures, 21C, 23C bored on the respective end sides of the opposing 5-1Cth electrode 51C.

Specifically, the surrounding portions of the electron beam passing apertures 21A, 21C (electron beam R passes in this embodiment) bored on one end sides of the two outside 5-1Ath electrode 51A and 5-1Cth electrode 51C are small in plate thickness, the surrounding portions of the electron beam passing apertures 22A, 22C (electron beam G passes in this embodiment) bored at the center are small in plate thickness, and the surrounding portions of the electron beam passing apertures 23A, 23C (electron beam B passes in this embodiment) bored on the other end sides are large in plate thickness. On the other hand, the surrounding portion of the electron beam passing aperture 21B (electron beam R passes in this embodiment) bored on one end side of the center 5-1Bth electrode 51B is large in plate thickness, the surrounding portion of the electron beam passing aperture 22B (electron beam G passes in this embodiment) bored at the center is small in plate thickness, and the surrounding portion of the electron beam passing aperture 23B (electron beam B passes in this embodiment) bored on the other side is small in plate thickness.

In the case of FIGS. 16 and 17, the red electron beam R, which passes at a relatively outside portion of the deflection magnetic field to the right-hand side of the screen, passes the electron beam passing apertures of small plate thickness, large plate thickness, and small plate thickness so that a convergence lens effect occurs in the focus lens of the divided 5-th electrodes 51 on the right-hand side of the screen, thereby resulting in the convergence lens effect being strengthened.

Conversely, the blue electron beam B, which passes at a relatively inside portion of the deflection magnetic field to the right-hand side of the screen, passes the electron beams of large plate thickness, small plate thickness and large plate thickness so that a divergence lens effect occurs in the focus lens of the divided 5-1th electrodes 51 on the right-hand side of the screen, thereby resulting in the convergence lens effect being weakened.

Incidentally, at that time, the center green electron beam G is not affected by the third focusing voltage Ef3 of the waveform similar to the sawtooth because the electron beam passing aperture 22B of the center 5-1Bth electrode 51B of the divided 5-1th electrodes is shielded by the shield body 26 protruded from the 5-1Cth electrode 51C.

Since the passing aperture through which the three electron beams, R, G, B pass in the respective 5-1th electrodes 51A, 51B, 51C are formed as described above, similarly to the first and second embodiments, differences of electron beam convergence actions exerted upon the two outside electron beams R, B by the deflection magnetic field may be canceled out so that the three electron beams R, G, B may be formed as the same satisfactory shape.

Incidentally, as a method of forming thin plate portions and thick plate portions, there is considered the following method, for example.

Figure 20A:
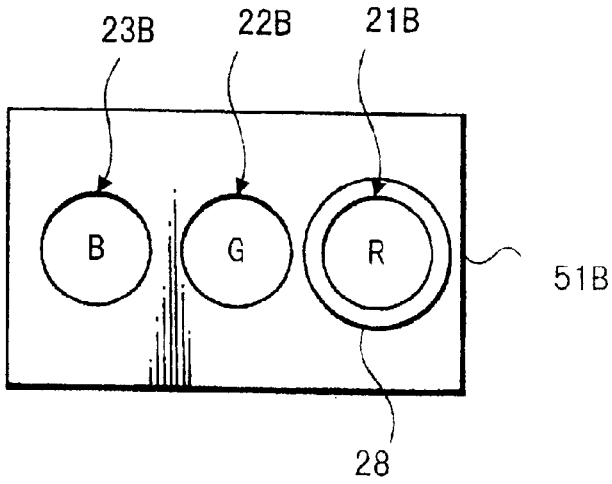
FIGS. 20A and 20B are diagrams used to explain the manner in which a plate thickness of an electrode is changed.
Figure 20B:
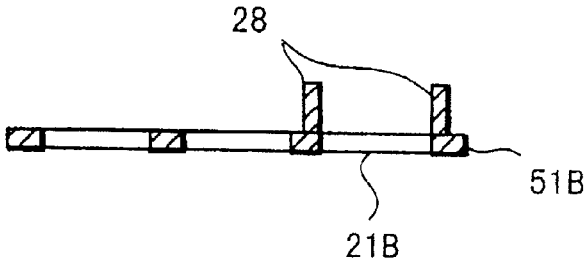

As shown by a plan view and a cross-sectional view of the 5-1Bth electrode 51B in FIGS. 20A and 20B, respectively, a cylindrical protrusion 28 is formed by processing the surrounding portion of the right electron beam passing aperture 21B with a burring press, thereby resulting in a substantial film thickness being increased.

While the shield body 26 is provided in the passing aperture of the center electron beam G in the above-mentioned first to third embodiments, the shield body may be removed.

Figure 18A:
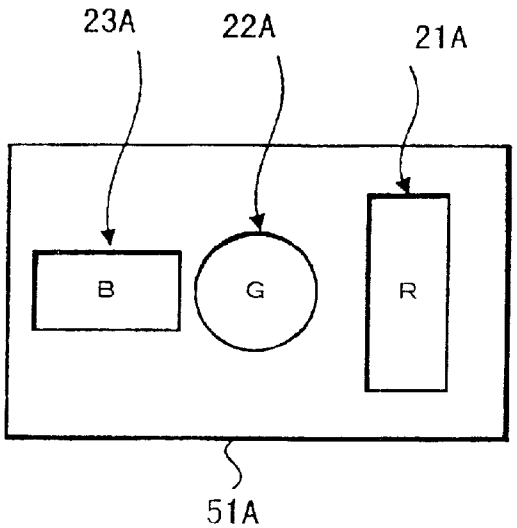
FIGS. 18A to 18C are diagrams showing a fourth embodiment of shapes f the sub-electrodes of the electron gun of FIG. 9.
Figure 18B:
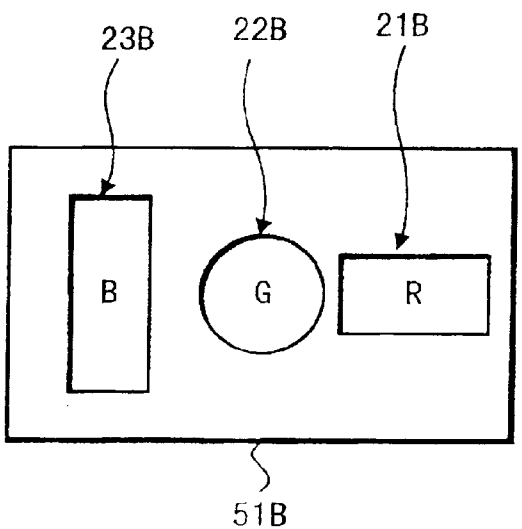
Figure 18C:
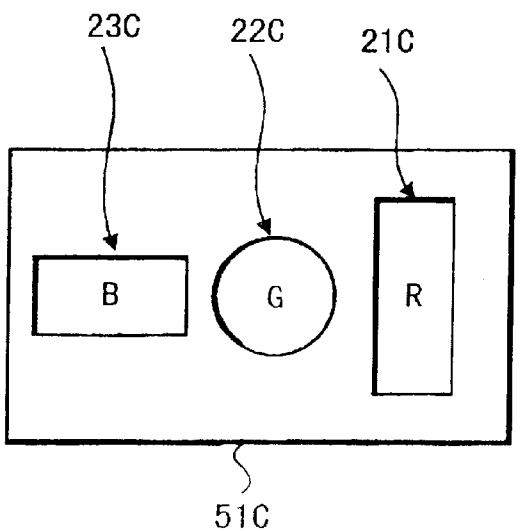
Figure 19B:
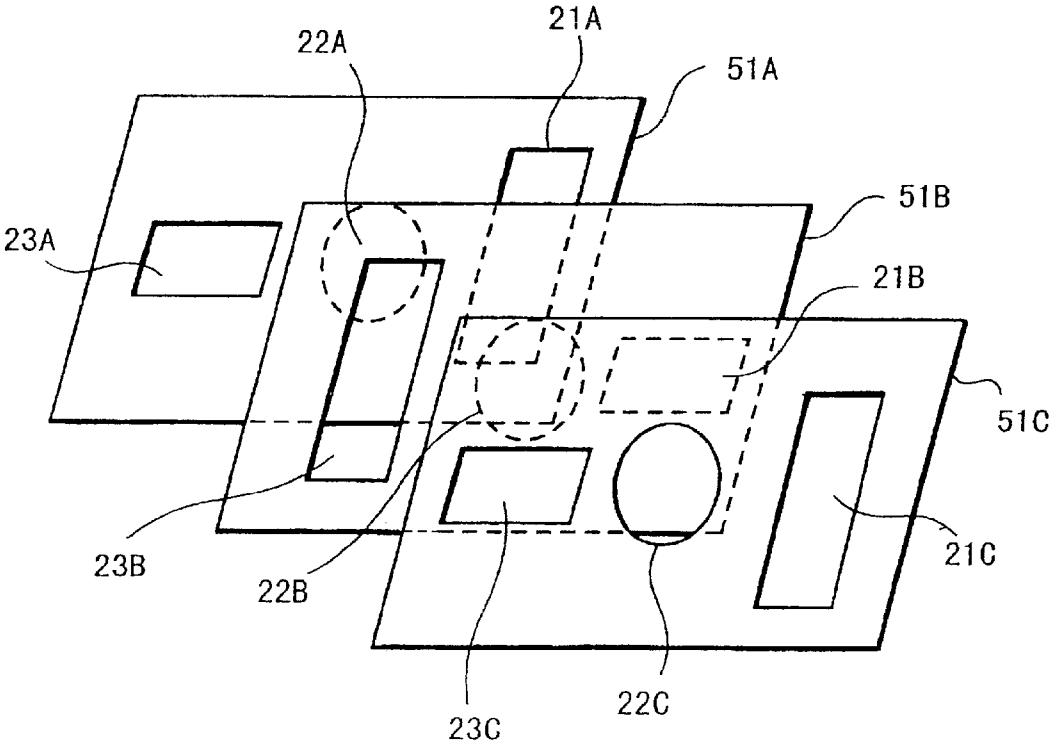
FIGS. 19A and 19B are diagrams showing a positional relationship of the sub-electrodes in the embodiment of FIG. 18.
Figure 19A:
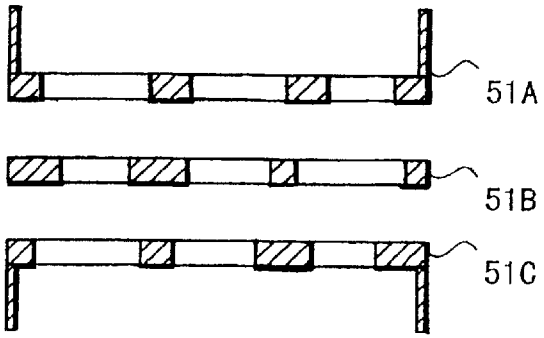

Then, as fourth embodiment, the arrangement in which the shield body is removed from the passing aperture of the center electron beam G in the first embodiment shown in FIG. 12 and 13 is shown in FIG. 18 and 19.

In the fourth embodiment, by restricting the astigmatic-shaped aspect ratio of the two outside electron beam passing apertures to a predetermined range (e.g. greater than 1.05), the influence exerted upon the center electron beam G by the deflection magnetic field may be removed so that the shield body need not be provided.

Since the rest of the arrangement is similar to that shown on FIGS. 12 and 13, elements and parts are marked with the same reference numerals and need not be described in detail.

Since the respective 5-1th electrodes 51A, 51B, 51C are arranged like the aforementioned respective embodiments, even the color cathode-ray tube electron gun 10 shown in FIG. 10, similarly to the previously-proposed color cathode-ray tube electron gun 50, the deflection magnetic field which act on the three electron beams R, G, B may be independently controlled at the respective electron beams, whereby differences of electron beam convergence effects may be canceled out. Thus, the three electron beams of satisfactory shapes may be obtained at the peripheral portions of the screen simultaneously.

While the main electron lens is of the QPF (Quadra Potential Focus) type in the above-mentioned embodiment shown in FIG. 9, the present invention may be applied to the bipotential type and the unipotential type color cathode-ray tube electron guns are mentioned before, and further may be applied to color cathode-ray tube electron guns of all sorts of types such as an electric field extension type of the like.

Also, while only one quadrupole lens exist between the 5-1Cth electrode 51C and the 51C and the 5-2th electrode 52 as in the above-mentioned embodiments, the present invention may be similarly applied to an arrangement in which a plurality of quadrupole lenses exist.

Next, a further embodiment of the present invention, there is shown an arrangement of a color cathode-ray tube electron gun in which both of a quadrupole lens component and a convergence lens component of the deterioration of the focusing of the red electron beam R and the blue electron beam B may be corrected with a sufficient sensitivity.

Figure 21:
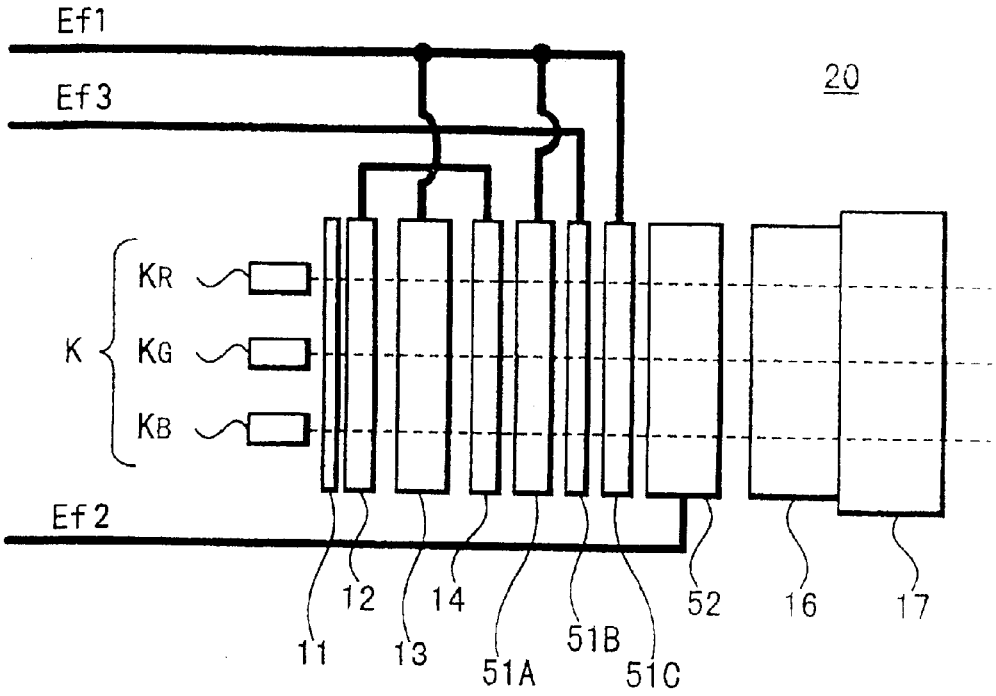
FIG. 21 is a schematic diagram showing an electrode layout of an electron gun according to other embodiment of the present invention.

FIG. 21 shows an electrode layout of a color cathode-ray tube electron gun according to the embodiment of the present invention.

In this color cathode-ray tube electron gun 20, similarly to the previously-proposed color cathode-ray tube electron gun 50 shown in FIG. 20, the 5-1th electrode 51 is divided to provide the 5-1Ath electrode 51A, the 5-1Bth electrode 51B and the 5-Cth electrode 51C.

Figure 22A:
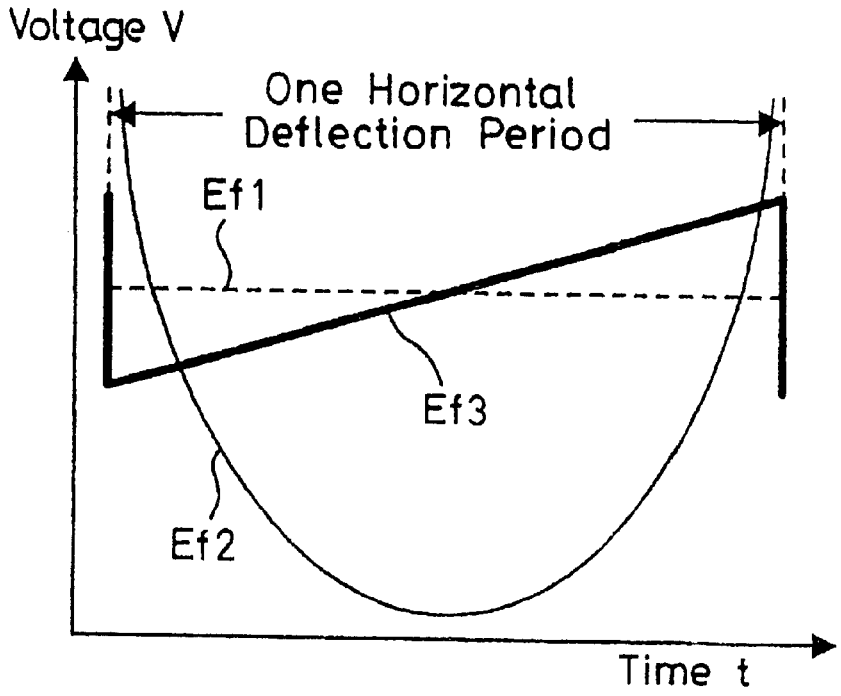
FIG. 22 is a diagram showing a mode of a voltage used in the electron gun of FIG. 21.
Figure 22B:
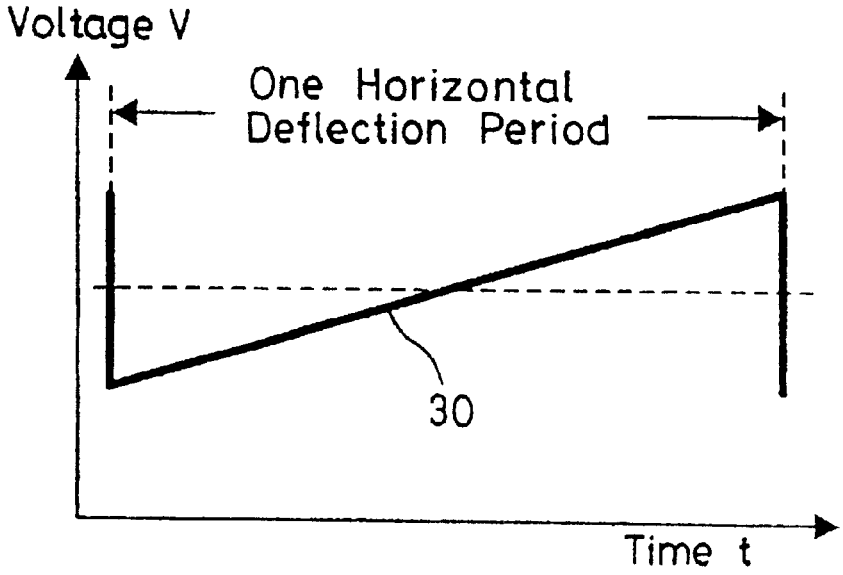

FIG. 22 shows a waveform of a focusing voltage applied to this color cathode-ray tube electron gun 20.

The first focusing voltage Ef1, which is the fixed voltage, is applied to the 5-1Ath electrode 51A and the 5-1Cth electrode 51C.

Then, the third focusing voltage Ef3in which a waveform voltage 30 of a shape similar to the sawtooth synchronized with the horizontal deflection superimposed upon the fixed voltage Ef1 is applied to the 5-1Bth electrode 51B.

Also, the second focusing voltage EF2 is the parabolic-shaped waveform voltage synchronized with at least the horizontal deflection (desirably, both of the horizontal and vertical deflections), and is applied to the 5-2th electrode 52 similarly to the conventional electron gun 70 shown in FIG. 1.

Further, in this embodiment, in order that both of the quadrupole component and the convergence lens component which cause the focus to be deteriorated, in particular, in the red electronbeam R and the blue electron beam B may be corrected, and the lens formed by the trisected 5-1th electrodes 51A, 51B, 51C, there are used two kinds of lenses of the quadrupole lens formed by the 5-1Ath electrode 51A and 5-1Bth electrode and the convergence lens formed by the 5-1Bth electrode 51B and the 5-1Cth electrode 51C.

FIG. 23 shows the electrodes shapes of the trisected 5-1th electrodes 51A, 51B, 51C in the color cathode-ray tube electron gun 20 of FIG. 21.

Figure 23A:
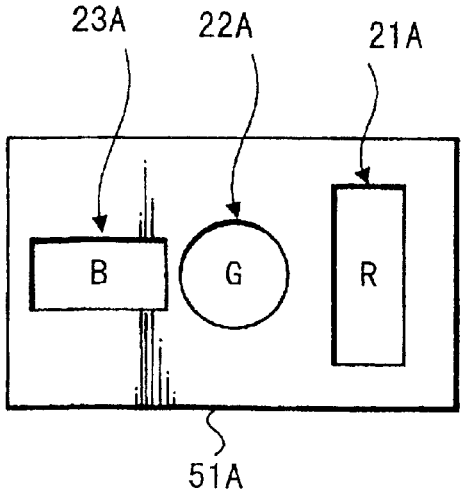
FIGS. 23A to 23D are diagrams showing a mode of shapes of sub-electrodes of the electron gun of FIG. 21.
Figure 23B:
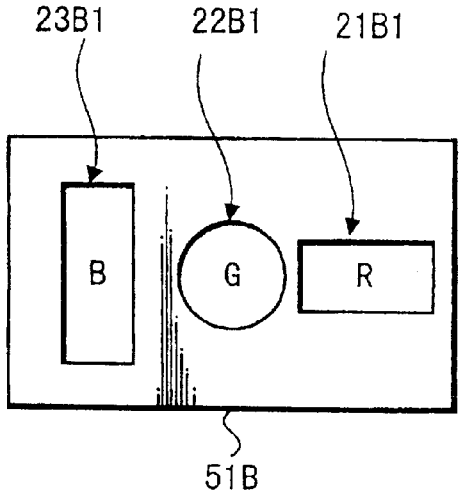

As shown on FIGS. 23A and 23B, on the 5-1Bth electrode 51B side of the 5-1Ath electrode 51A and the 5-1Ath electrode 51A side of the 5-1Bth electrode 51B, the passing apertures 21A, 21B1 of the red electron beam R are vertically-oblong and horizontally-oblong rectangular shapes, respectively and the passing apertures 23A, 23B1 of the blue electron beam B are horizontally-oblong and vertically-oblong rectangular shapes, respectively.

That is, the opposing passing apertures are formed as astigmatic shapes which are opposite to each other.

Figure 23C:
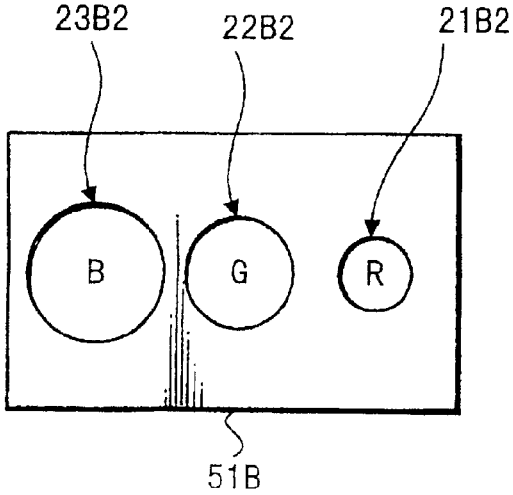
Figure 23D:
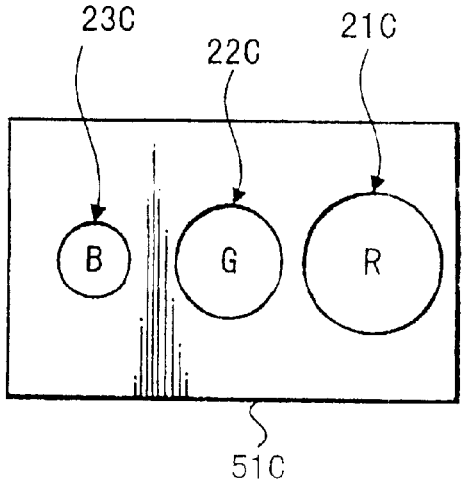

Also, as shown in FIGS. 23C and 23D, on the 5-1Cth electrode side of the 5-1Bth electrode 51B and the 5-1Bth electrode 51B side of the 5-1Cth electrode 51C, the passing apertures 21B2, 21C of the red electron beam R are small in passing aperture diameter and large in passing aperture diameter, respectively, and the passing apertures diameter and small in passing aperture diameter.

Incidentally, the center passing apertures 22A, 22B1, 22B2, 22C of the green electron beam G are all formed as circular-shapes with the same diameter, and on the 5-1Cth electrode 51C side of the 5-1Bth electrode 51B and the 5-1Cth electrode 51C, their diameters are between the diameters of the passing apertures of the two outside electron beams R, B.

If the electrodes and the electron beam passing apertures of the trisected 5-1th electrodes 51A, 51B, 51C are arranged as described above, then the quadrupole lens is formed at the portion in which the 5-1Ath electrode 51A and the 5-1Bth electrode 51B are opposed to each other, and the convergence lens is formed at the portion in which the 5-1Bth electrode 51B and the 5-1Cth electrode 51C are opposed to each other.

Then, by this electrode structure and the applied waveform voltage, on the left-hand end of the screen, a quadrupole lens action for making the beam become vertically-oblong is applied to the blue electron beam B, and a quadrupole lens action for making the beam become horizontally-oblong is applied to the red electron beam R.

Also, a convergence lens action smaller than that applied to the blue electron beam B is applied to the center red electron beam R.

Then, the quadrupole lens action is not applied to the green electron beam G but a convergence lens action with an intermediate intensity between the intensities of the convergence lens action applied to the red electron beam R and the blue electron beam B is applied to the green electron beam.

Thus, only by adding a focusing voltage of a new one system referred to as Ef3 to the focusing voltage supplied to the conventional electron gun, it is possible to simultaneously cancel both the convergence lens action component within a difference between the red electron beam R and the blue electron beam B of lens actions caused by the deflection magnetic field and the quadrupole lens action component. Thus, focusing characteristics in which the red electron beam R and the blue electron beam B are both satisfactory may be obtained on the whole region of the screen.

According to the arrangement of the conventional electron gun, in order to protect the conventional lens structure from being affected, the electron gun needs a uni-potential type lens structure, and potentials of the electrodes at both ends of the electrodes comprising a lens to be added newly have to be made the same as those of the conventional electron gun. As a result, an intensity of, in particular, a convergence lens becomes short.

Conversely, when the bi-potential type convergence lens is formed in order to obtain the convergence lens intensity with a priority, there occurs the following phenomenon.

An undesired convergence lens is produced on the opposing surface opposite to the convergence lens of the two electrodes forming the lens at its electrode to which the dynamic voltage waveform Ef3 is applied. That is, the conventional lens structure is influenced.

As a result, even when the correction action is generated by the lens, the conventional lens action also is changed so that an intended correction effect cannot be obtained any more.

On the other hand, according to the color cathode-ray tube electron gun 20 of the above-mentioned embodiment, without influencing the lens structure of the conventional electron gun, it is possible to form convergence lens and quadrupole lens of a new bi-potential type.

The reason for this is that, although the convergence lens and quadrupole lens thus newly formed are both of the bi-potential structure, th lens action generated by the third focusing voltage Ef3 remains only in these two lenses.

Figure 24A:
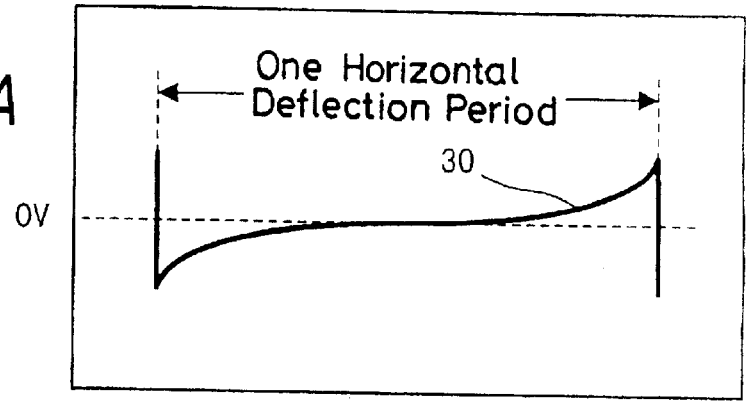
FIGS. 24A and 24B are diagrams showing another mode of a waveform of a waveform voltage used in the electron gun of FIG .21.
Figure 24B:
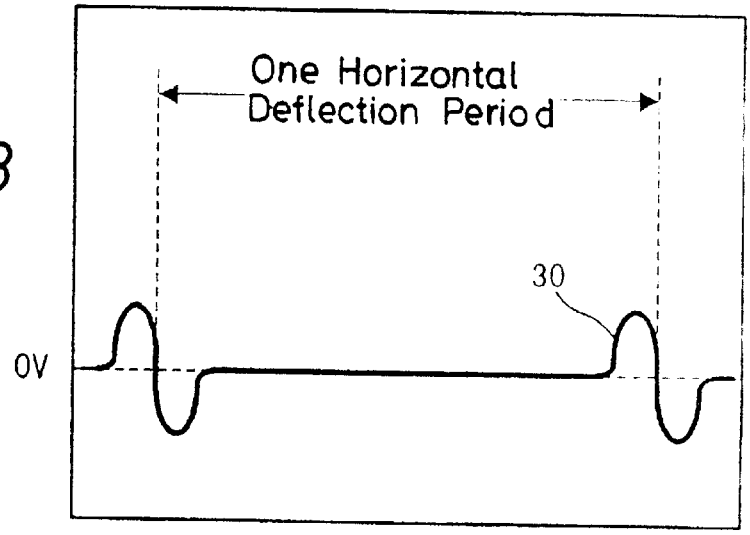

Incidentally, although the waveform of the third focusing voltage Ef3 in FIG. 22 is obtained by adding/substracting the waveform voltage 30 of the shape similar to the sawtooth to/from the fixed focusing voltage Ef1, instead of this waveform voltage 30, the waveform voltage 30 similar to the sawtooth which changes in a curve fashion in synchronism with the horizontal deflection period as shown in FIG. 24A or the waveform voltage 30 in which a sine wave voltage is intermittently generated at every horizontal deflection period as shown in FIG. 24B may be added/subtracted to/from the fixed focusing voltage.

Also, the shapes of the electron beam passing apertures of the electrodes forming the quadruple lens, i.e. the 5-1Bth electrode 51B side of the 5-Ath electrode 51A and the 5-Ath electrode 51A side of the 5-Bth electrode 51B are not limited to the rectangular shapes shown in FIGS. 23A and 23B and may be other astigmatic shapes such as shapes in which screen-like protrusions are formed.

Further, the electron beam passing apertures 21B2, 22B2, 23B2 on the electrodes forming the convergence lens, i.e. on the 5-1Cth electrode 51C side of the 5-Bth electrode 51B and the electron beam passing apertures 21C, 22C, 23C on the 5-Bth electrode 51B side of the 5-1C electrode 51C are not limited to the combinations of the small passing aperture diameter and the large passing aperture diameters shown in FIGS. 23C and 23D and may be the combination in which the passing aperture diameter is selected to be the same and plate thickness of the peripheral portions of the electron beam passing apertures are changed. In that case, the peripheral portions of the electron beam passing apertures 23B2, 21C shown by the large passing aperture diameters FIGS. 23C and 23D are made small in plate thickness and the peripheral portions of the electron beam passing apertures 21B2, 23C shown by the small passing aperture diameters are made large in plate thickness.

Figure 25:
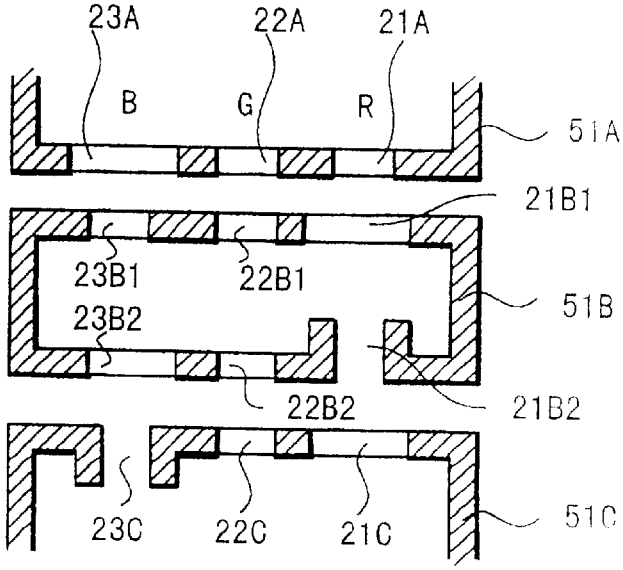
FIG. 25 is a diagram showing other mode of shapes of sub0electrodes of the electron gun of FIG. 21.

FIG. 25 shows the embodiment of the electrodes shapes of the 5-1th electrode 51A, 51B, 51C obtained when the plate thickness of the peripheral portions of the electron beam passing apertures are changed.

In the embodiment shown in FIG. 25, the peripheral portion of the passing aperture 21B2 of the red electron beam R on the 5-1Cth electrode 5C of the 5-1Bth electrode 5B in processed by burring the press treatment and is thereby made large in the plate thickness. The peripheral portion of the passing aperture 23C of the blue electron beam B on the 5-1Bth electrode 51B side of the 5-1Cth electrode 51C also is processed similarly as described above.

Conversely, the peripheral portion of the passing aperture 23B2, of the blue electron beam B on the 5-1Cth electrode 51C side of the 5-1thB electrode 51B has a plate thickness smaller than that of the peripheral portion of the passing aperture 21B2 of the red electron beam R. Also, the peripheral portion of the passing aperture 21C of the red electron beam R on the 5-Bth electrode 51B side of the 5-Cth electrode 51C has a plate thickness smaller than that of the peripheral portion of the passing aperture 23C of the blue electron beam B, similarly.

Other portions are similar to those of the embodiments previously shown in FIGS. 21 to 23. The two outside electron beam passing apertures 21A, 23A, of the 5-1th electrode 51A and the two outside electron beam passing apertures 21B1, 23B1 of the 5-1Ath electrode side of the 5-1Bth electrode 51B are formed as astigmatic shapes opposite to those of the electron beam passing apertures which are opposed to each other.

Also, in the embodiment shown in FIG. 25, by devising the technique in which the passing aperture diameters are changed at the same time in the film thicknesses of the electron beam passing apertures are changed, in the tow outside electron beam passing apertures 21B2 and 21C, 23B2 and 23C of the opposing 56-Bth electrode 51B and 5-1Cth electrode 51C, one is made large in diameter, and the other is made small in diameter.

According to the above-mentioned arrangement, of the lenses formed between the 5-Bth electrode 51B to the 5-1Cth electrode 51C, the intensity of the lens on the 5-1th electrode 51B side with respect to the red electron beam R and the intensity of the lens on the 5-Cth electrode 51C side with respect to the blue electron beam B may be made larger than that of the 5-1Cth electrode 51C side with respect to the red electron beam R and that of the 5-1Bth electrode 51B side with respect to the blue electron beam B.

Thus, the convergence lens action component of difference between the red electron beam R and the blue electron beam B may be canceled, and hence satisfactory focusing characteristics of both of the red electron beam B and the blue electron beam B may be obtained on the whole region of the screen.

Also, in the electron guns show in FIGS. 21 to 23 and FIG. 25, the waveform voltage Ef3 similar to the sawtooth sown in FIG. 22 is adopted as the third focusing voltage Ef3. The structure of the passing aperture of the red electron beam R in these drawings may be applied to the structure of the passing aperture of the blue electron beam B may be applied to the structure of the passing aperture of the red electron beam R, i.e. the structure of the passing aperture of the red electron beam R and the structure of the passing aperture of the blue electron beam B may be reversed. In this case, a waveform which results from inverting the left and right the waveform voltage Ef3 is applied.

The color cathode-ray tube electron gun according to the present invention is not limited to the above-mentioned embodiments and may be variously modified without departing from the gist of the present invention.

The present invention further provides a color cathode-ray tube electron gun including trisected electrodes comprising a uni-potential lens and in which a voltage of a waveform synchronized with a horizontal direction deflection and a vertical direction deflection is applied to a center electrode of the trisected electrodes.

Also, according to the present invention, in the above mentioned color cathode-ray tube electron gun it includes electrodes divided by five and wherein there electrodes on the cathode side and three electrodes on the anode side of the electrodes divided by five comprise two trisected electrodes each comprising a uni-potential lens.

Also, according to the present invention, the above-mentioned color cathode-ray tube electron gun, the trisected electrodes are focusing electrodes.

Also, according to the present invention, in the above-mentioned color cathode-ray tube electron gun, the trisected electrodes are a fourth electrode.

Also, according to the present invention, in the above-said color cathode-ray tube electron gun, voltages of different waveforms synchronized with the horizontal direction deflection and the vertical direction deflection are waveforms formed as parabolic shapes at every horizontal direction deflection period.

Also, according to the present invention, in the above-mentioned color cathode-ray tube electron gun, two outside electrodes and a center electrode of the trisected electrodes, two outside electron beam passing apertures of one electrode are deviated on the outside in the horizontal direction and two outside electron beam passing aperture of the other electrode are deviated on the inside in the horizontal direction.

Also, according to the present invention, in the above-mentioned color cathode-ray tube electron gun, in each electrode of the trisected electrodes, one outside electron beam passing aperture and the other outside electron beam passing aperture are deviated from each other on the opposite side in the vertical direction, and in opposing two electrodes, electron beam passing apertures corresponding to the same outside electron beam are deviated from each other on the opposite side in the vertical direction.

Also, according to the present invention, in the above mentioned color cathode-ray tube electron gun, in the two trisected electrodes, one trisected electrode comprises two outside electrodes and a center electrode wherein two outside electron beam passing apertures of one electrode are deviated on the outside in the horizontal direction and two outside electron beam passing apertures of the other electrode are deviated on the inside in the horizontal direction, ad in the other trisected electrodes, in each electrode of the trisected electrodes, one outside electron beam passing aperture are deviated from each other on the opposite side in the vertical direction and in the opposing two electrodes, electron-beam passing apertures corresponding to the same outside electron beam are deviated from each other o the opposite side in the vertical direction.

Figure 26:
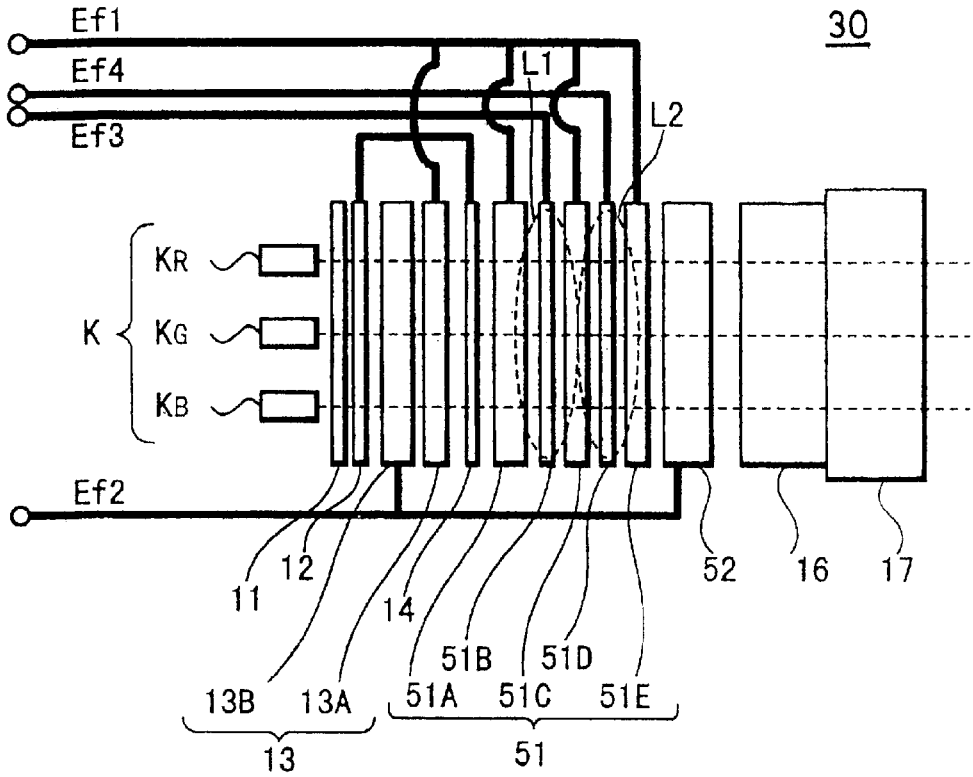
FIG. 26 is a schematic diagram showing an electrode layout of an electron gun according to an embodiment of the present invention.

FIG. 26 shows an electrode.layout of a color cathode-ray tube election gun according to an embodiment of the present invention.

The color cathode-ray tube electron gun according to this embodiment includes focusing electrodes divided by five there electrodes thereof on the cathode side constitute a first uni-potential lens and three electrodes thereof on the anode side constitute a second uni-potential lens.

This electron gun 30 includes three cathodes KR, KG, KB that are parallelly arrayed in an inline fashion. From the cathodes K ($K_R$, $K_G$, $K_B$) to the anode side, there are coaxially disposed a first electrode 11, a second electrode 12, a third electrode 13, a fourth electrode 14, a fifth-electrode 51, 52, a sixth electrode 12 and a shield cap 17, in that order. The second electrode 12 and the fourth electrode 14 are electrically connected.

The third electrode 12 and the fifth electrode 51, 52 are convergence electrodes (focusing electrodes) and held at potentials ranging from 4kv to 10Kv.

Also, the sixth electrode is an acceleration electrode and held at a potential ranging from 20kV to 30kV.

A pre-focusing lens in arranged between the cathode K and the third electrode 12, a first convergence lens (focusing lens) is arranged between the third electrode 13 and the fifth electrode 51, 52, and a main convergence lens is arranged between the fifth electrode 51, 52 and sixth electrode 16.

Then, the third electrode 13 is dived to provide a 3Ath electrode 13A and a 3Bth electrode 13B, and the fifth electrode is divided by half to provide a 5-1th electrode 51 and a 5-2th electrode 52.

Further, in this embodiment, the 5-1th electrode 51, in particular, is divided by five to provide a 5-1Ath electrode 51A, a 5-1Bth electrode 51B, a 5-1Cth electrode 51C, a 5-1Dth electrode 51D and a 5-1Eth electrode 51E, in that order from the cathode side.

Then, of these five electrodes, the three electrodes 51A, 51B 51C on the cathode side constitute a first lens (uni-potential lens,) L1, and the three electrodes 51C, 51D, 51E on the anode side constitute a second lens (uni-potential lens) L2.

A constant first focusing voltage (fixed focusing voltage) Ef1 is applied through a stem portion to the 3Ath electrode 13A of the third electrode 13 on the anode side and to the three outside electrodes 51A, 51C, 51E of the five electrodes 51A, 51B, 51C and 51C, 51D, 51E of the 5-1th electrode 51 constituting the first lens L1 and the second lens L2.

Figure 7:
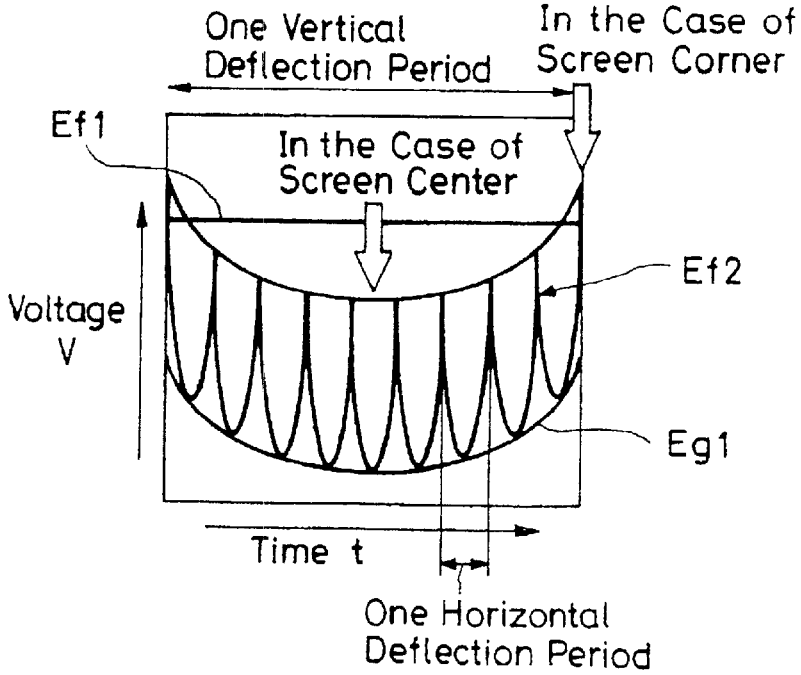
FIG. 7 PRIOR ART
FIG. 7 is a diagram showing waveforms of first and second focusing voltages used in the electron gun of FIG. 6.

On the other hand, a second focusing voltage (i.e. the voltage shown in FIG. 27 which is a parabolic waveform synchronized with the horizontal deflection, so-called downwardly-convexed parabolic waveform is superimposed upon a parabolic-shape background voltage Eg1 synchronized with the vertical deflection so as to become a low voltage on the screen center) Ef2 of the same shape as that previously shown in FIG. 7 is applied to the 3Bth electrode 13B on the cathode side of the third electrode 13 and the 5-2th electrode 52.

Incidentally, the amplitude of this second focusing voltage Ef2 is substantially constant.

Figure 28:
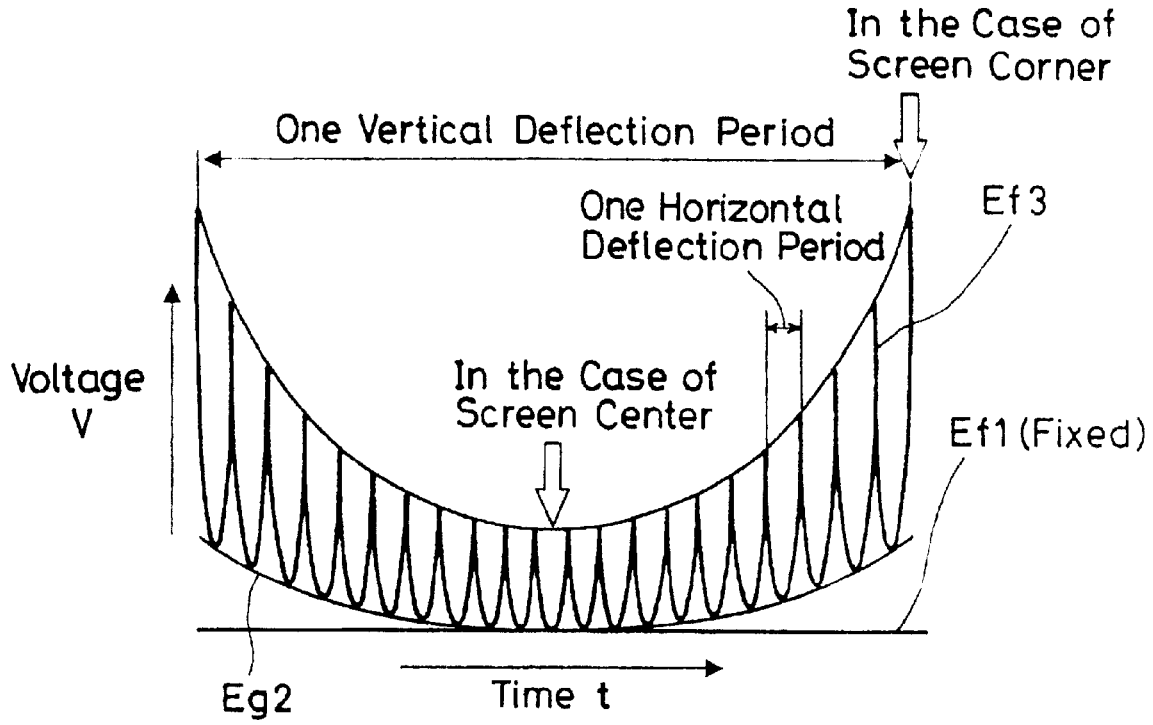
FIG. 28 is a diagram showing waveforms of first and third focusing voltages used in the electron gun of FIG. 26

Further, a third focusing voltage Ef3 shown in FIG. 28 is applied to the center electrode 51B of the three electrodes 51A, 51B, 51C of the 5-1th electrode 51 constituting the first lens L1.

This third focusing voltage Ef3 is a voltage which results from superimposing the parabolic waveform synchronized with one horizontal deflection, so-called downwardly-convexed parabolic waveform upon a parabolict-shape background voltage Eg2 synchronized with the vertical deflection and which becomes a high voltage on the screen corner and which becomes a low voltage at the screen center.

Also, the amplitude of this third focusing voltage Ef3 is large on the screen corner and becomes minimum at the screen center.

As described above, with application of the third focusing voltage Ef3 to the 5-1Bth electrode 51B, the horizontal direction convergence of the three electron beams R, G, B may be adjusted on the whole surface of the screen by adjusting the lens effect of the first lens L1.

The shape of the waveform of this third focusing voltage Ef3 is not always symmetrical with respect to the center of the screen and may become asymmetrical if the fluctuations are adjusted.

Figure 29B:
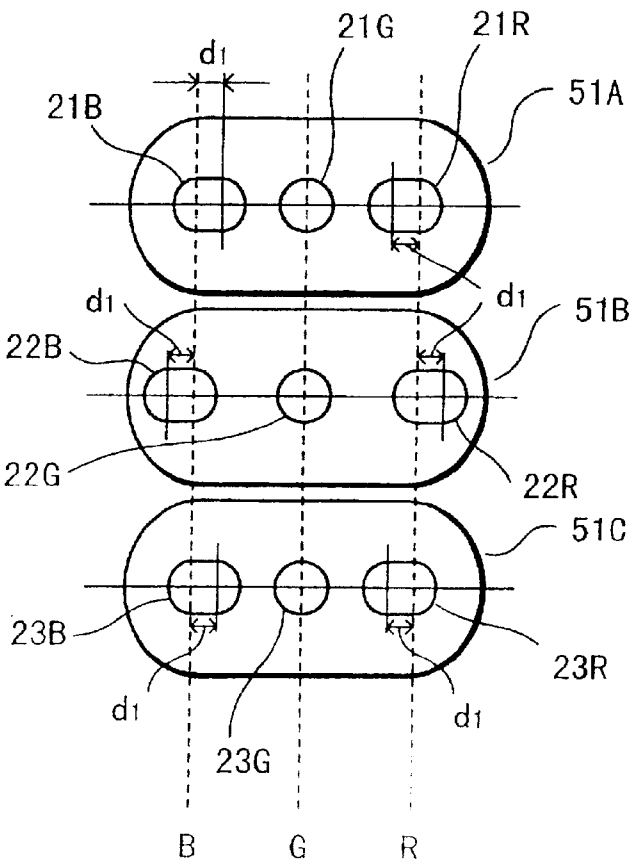
FIGS. 29A and 29B are diagrams showing shapes of electron beam passing apertures of electrodes comprising a first lens in the electron gun of FIG. 26.
Figure 29A:
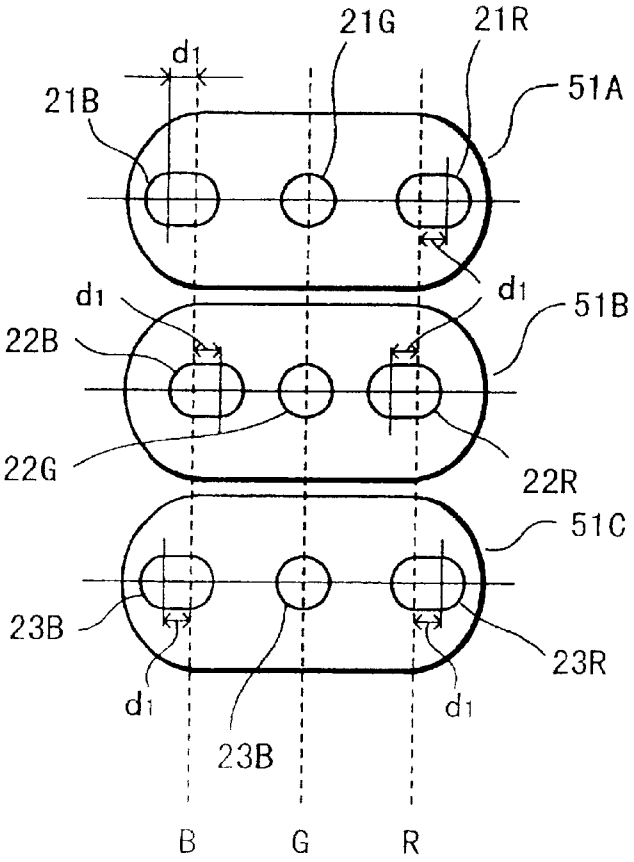

Next, FIG. 29A shows shapes of opening portions of electron beam passing apertures on the opposing surfaces of the 5-1Ath electrode 51A, the 5-1Bth electrode 51B, the 5-1Cth electrode 51C obtained at that time.

Of the electron beam passing aperture through which the three electrons beams R, G, B pass, aperture pitches (i.e. intervals between them and the passing apertures 21G, 22G, 23G of the center electron beam G) of the passing apertures 21B, 22B, 23B, and 21R 22R, 23R of the two outside electron beams B, R are widened in the 5-1Ath electrode 51A, the 5-1Cth electrode 51C and are narrowed in the 5-1Bth electrode 51B.

That is, of the three electrodes 51A, 51B, 51C constituting the first lens L1, the passing apertures 21B, 23B, and 21R, 23R of the two outside electron beams B, R of the two outside electrodes 51A, 51C are deviated to the outside by $d_1$, and the passing apertures 22B and 22R of the two outside electron beams B, R of the center electrode 51B are deviated to the inside by $d_1$.

A principle for correcting convergence will be described as follows.

Figure 32:
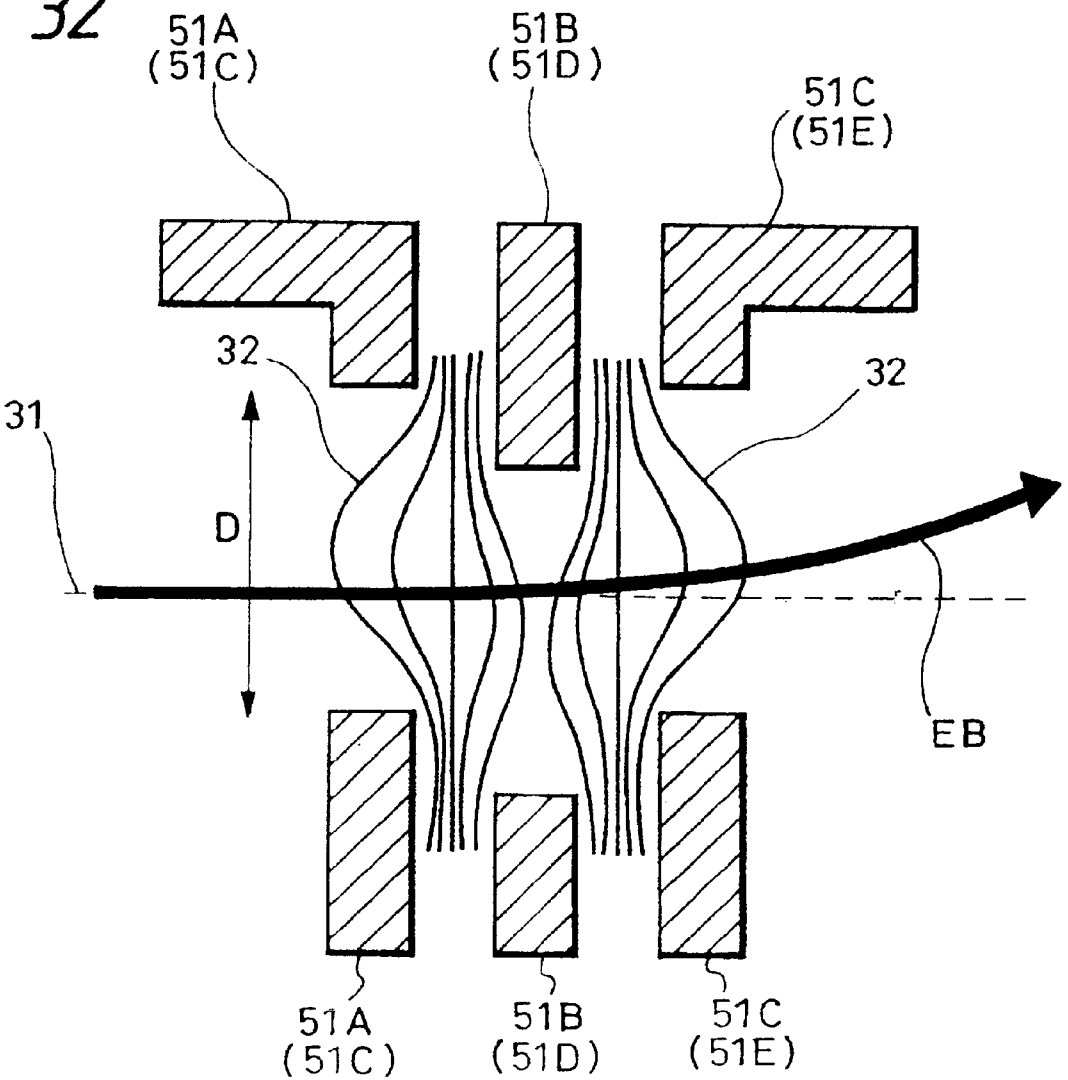
FIG. 32 is a cross-sectional view usedto explain a convergence correction principle.

In both outside electron beam passing apertures 21B, 22B, 23B and 21R, 22R, 23R, if a potential difference occurs between the first focusing voltage (fixed focusing voltage) Fe1 and the third focusing voltage Ef3 with respect to the first lens L1 composed of the 5-1Ath electrode 51A, the 5-1thB electrode 51B, the 5-1Cth electrode 51C, then since the electron beam passing apertures 21B, 22B, 23B, and 21R, 22R, 23R (opening diameter D) of the respective electrodes 51A, 51B, 51C are deviated, an application direction of an electric field is deviated, i.e. as shown in FIG. 32, an equipotential line 32 is deviated from an aperture so that an electron beam orbit EB the of two outside electron beams R, B is changed and deviated from the aperture axis 31 of the opening of the electron beam passing aperture.

Figure 33:
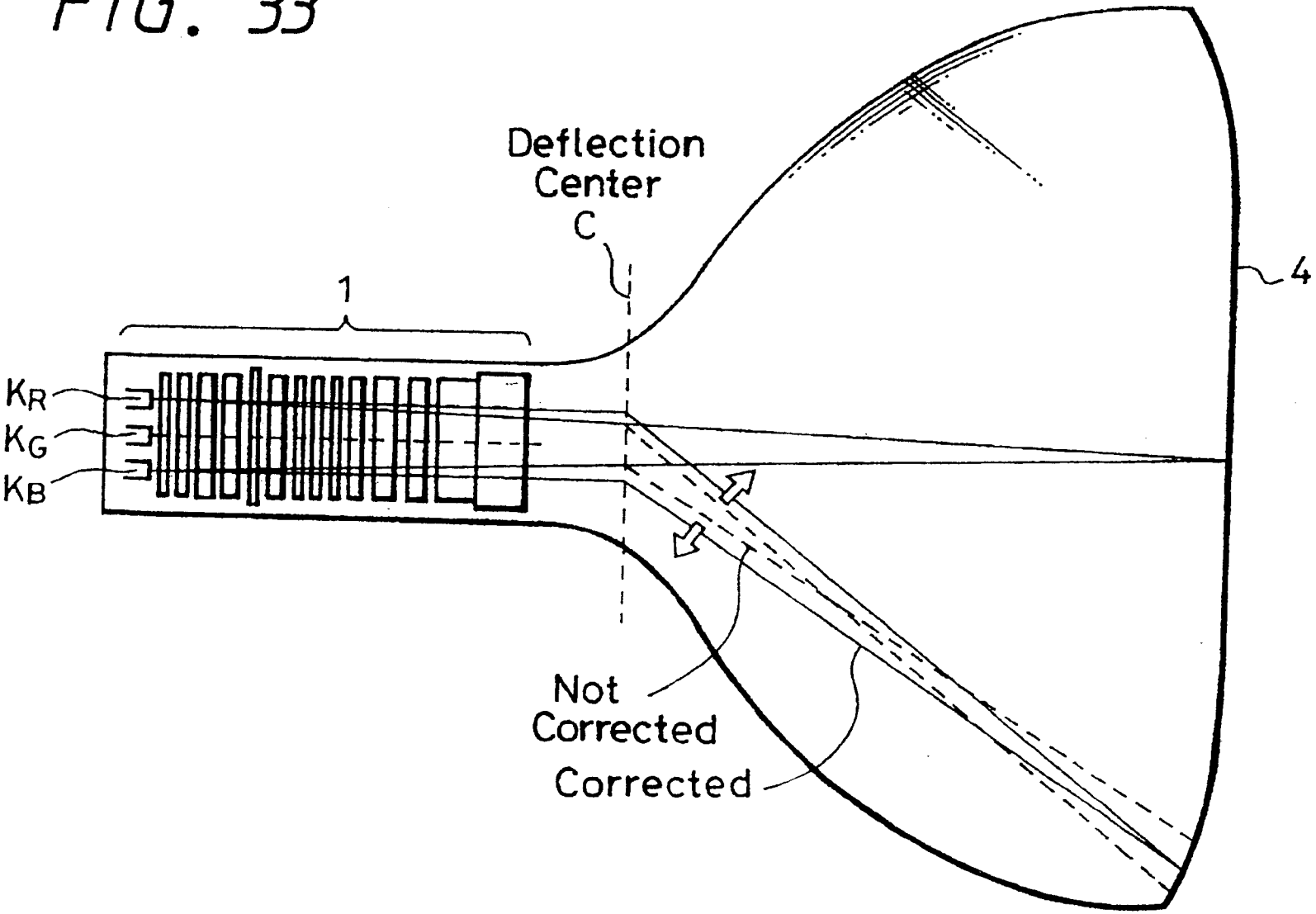
FIG. 33 is a diagram showing a convergence correction effect in a color cathode-ray tube.

If so, as shown in FIG. 33, the three electron beams R, G, B may be converged even at the peripheral portions of the fluorescent screen 4.

If the convergence correction shown by a broken line in the drawing is not effected, even upon scanning the peripheral portions of screen, because the three electron beams R, G, B pass through the same orbit as upon scanning the center of screen through a deflection center C, the electron beams are converged on the way and not converged on the screen 4.

On the other hand, if the convergence is corrected as shown by a solid line in the drawing, then when electron beams scan the peripheral portions of the screen, an electron beam orbit is corrected through the deflection center C and the orbit is widened as shown by bold arrow, accordingly, the three electron beams R, G, B may be converged even on the peripheral portions of the screen.

Also, when the waveform of FIG. 28 is changed into a waveform in which the polarity is invented (i.e. so-called upwardly-convexed parabolic-shaped waveform), with respect to the shapes of the respective electron beam passing apertures, as shown in FIG. 29B, a relationship of aperture pitches becomes opposite to that of FIG. 29A, wherein the aperture pitch is narrowed in the two outside electrodes 51A, 51C and the aperture pitch is widened in the center electrode 51B.

Figure 8A:
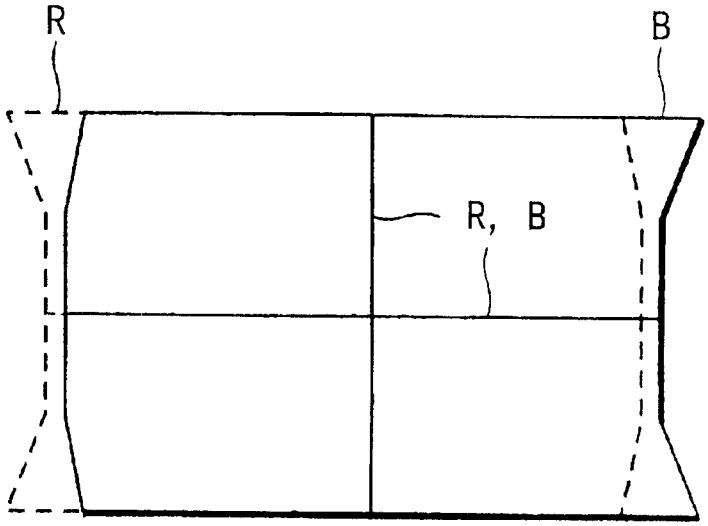
FIG. 8A PRIOR ART
FIG. 8A is a diagram showing a horizontal direction mis-convergence.

Incidentally, depending upon the design of the deflection yoke, the mis-convergence pattern in the horizontal direction is not always represented by the shape of FIG. 8A.

Figure 4:
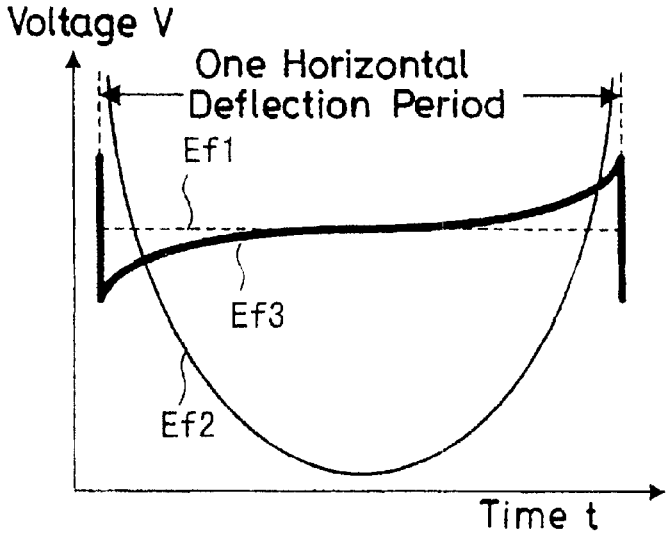
FIG. 4 PRIOR ART
FIG. 4 is a diagram showing examples of waveforms of focusing voltages applied to the electron gun of FIG. 3.
Figure 5B:
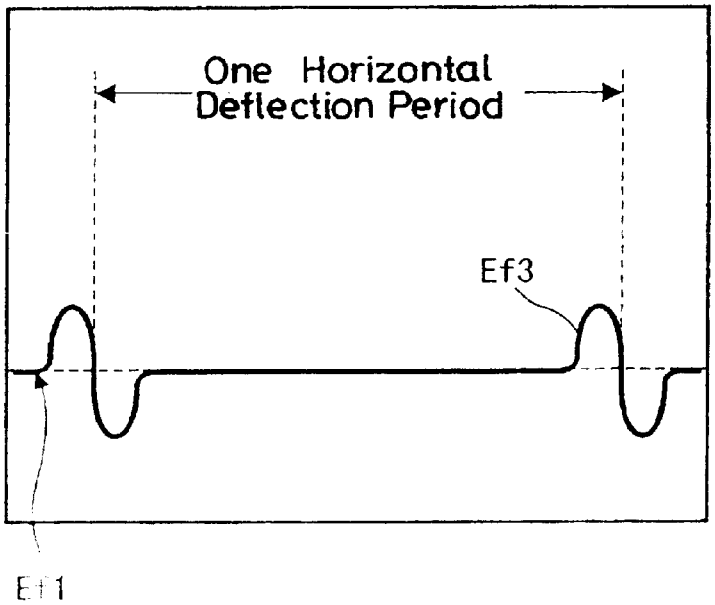
FIG. 5B PRIOR ART
FIGS. 5A and 5B are diagrams showing further examples of waveform voltages applied to the electron gun of FIG. 3.
Figure 5A:
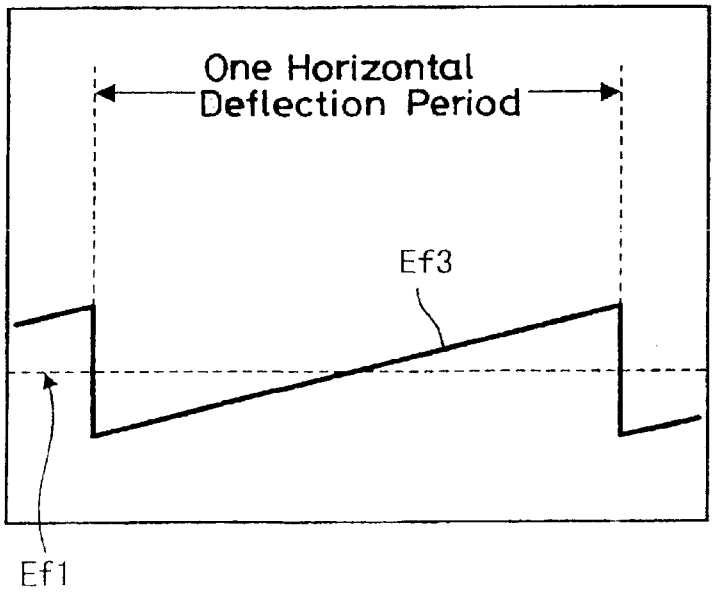
FIG. 5A PRIOR ART

In that case, if the electron beam passing apertures are shaped as shown in FIG. 4A or 4B and a voltage of an arbitrary waveform is applied to the 5-1Bth electrode 51B, then the mis-convergence in the horizontal direction may be adjusted.

Incidentally, while both of the deviation amount of the passing apertures of the outside electron beams R, G are equal to $d_1$ in FIGS. 29A and 29B, depending upon the mis-convergence state, the deviation amount d' in the center electrode 51B may be made different from the deviation amounts $d_1$ in the outside electrodes 51A, 51C.

Also in this case, the deviation amount of the passing aperture of the red electron beam R and the deviation amount of the passing aperture of the blue electron beam B in the same electrode may be the same.

Figure 30:
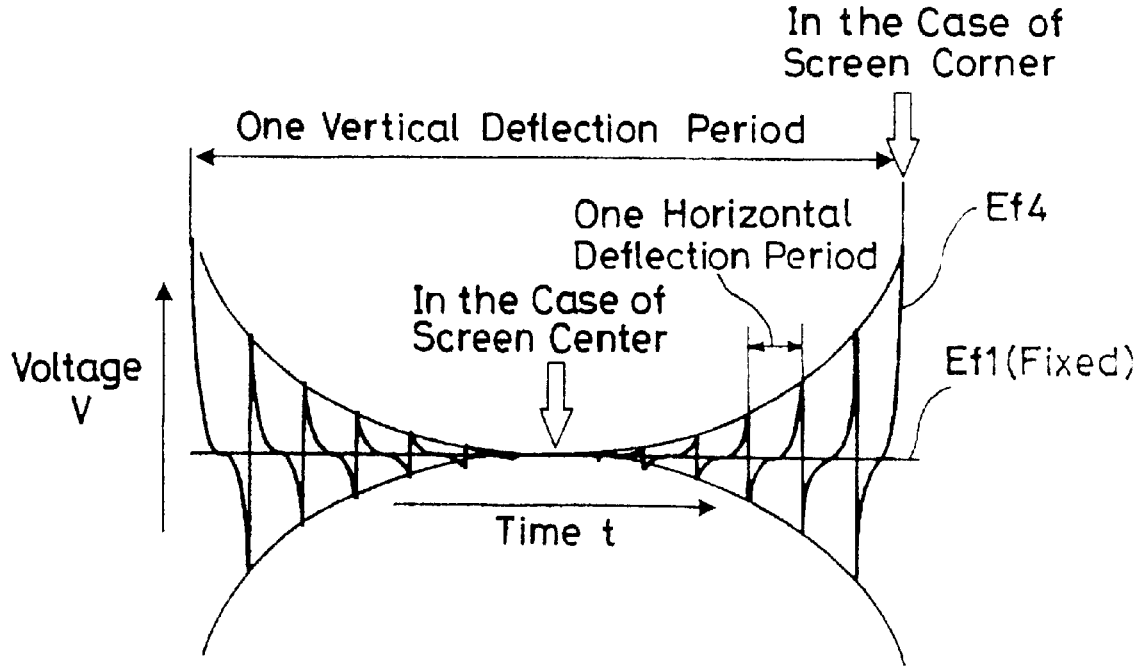
FIG. 30 is a diagram showing waveforms of first and fourth focusing voltages used in the electron gun of FIG> 26.

On the other hand, a fourth focusing voltage Ef4 shown in FIG. 30 is applied to the center electrode 51D within the three electrodes 51C, 51D, 51E of the 5-1th elctrode 51 comprising the second lens L2.

This fourth focusing voltage Ef4 is a voltage in which a waveform of a shape similar to the sawtooth sychronized with one horizontal deflection is superimposed upon the fixed focusing voltage Ef1. The waveform of the shape similar to the sawtooth becomes a waveform which decreases from a high voltage to a low voltage at every one horizontal deflection period in the first half of one vertical deflection period and a waveform which decreases from a low voltage to a high voltage at every one horizontal deflection period in the second half of one vertical deflection period.

Also, the amplitude of this fourth focusing voltage Ef4 becomes large at the screen corner and becomes minimum and substantially 0V at the screen center.

By applying the fourth focusing voltage Ef4 to the 5-1Dth electrode 51D and then adjusting the lens effect of the second lens L2 as described above, the convergence in the vertical direction of the three electron beams R, G, B may be adjusted on the whole surface of the screen.

The shape of the waveform of this fourth focusing voltage EF4 is not always symmetrical but may become asymmetrical including the adjustment of fluctuations.

Figure 31B:
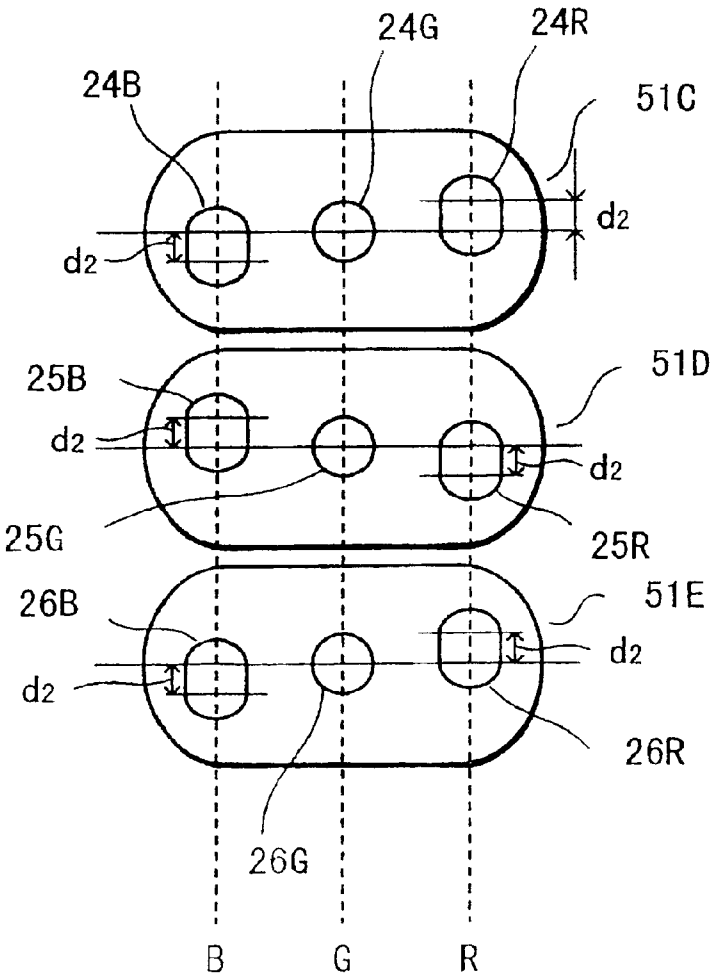
FIGS. 31A and 31B are diagrams showing shapes of electron beam passing apertures of electrodes comprising a second lens in the electron gun of FIG. 26.
Figure 31A:
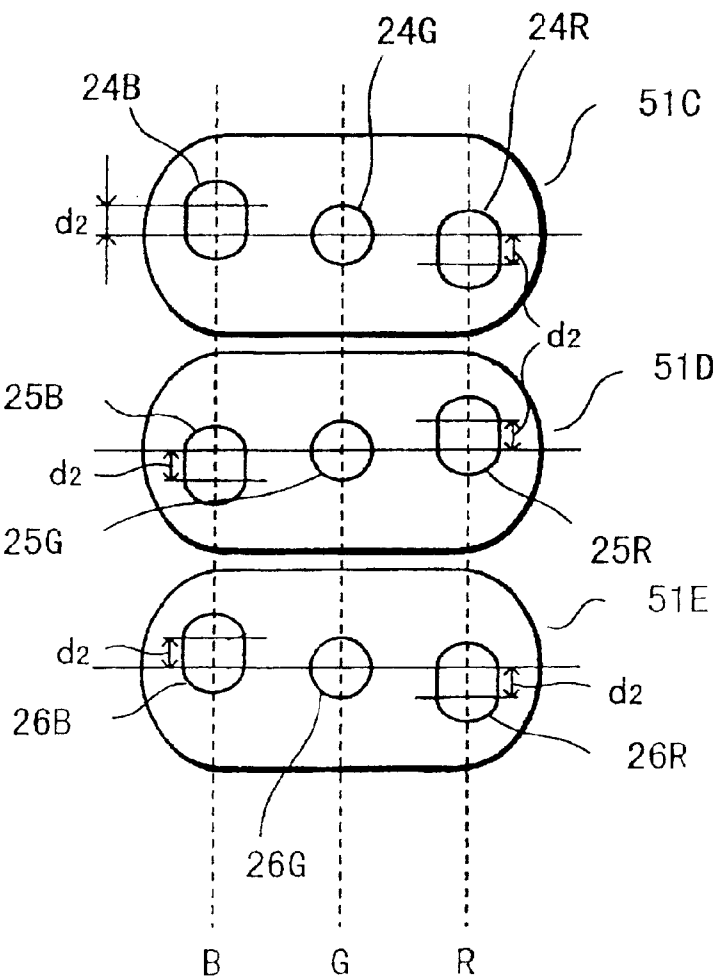

Next, FIG. 31A shows shapes of opening portions of electron beam passing apertures on the opposing surfaces in the 5-1Cth electrode 51C, the 5-1Dth electrode 51D, the 5-1Eth electrode 51E.

Of the electron beam passing apertures through which the three electron beams R, G, B pass, with respect to the passing apertures 24B, 25B, 26B and 24R, 25R, 26R of the two outside electron beams B, R, the passing apertures 24B, 26B of the blue electron beam B and deviated by $d_2$ upwardly in the two outside electrodes, i.e., 5-1Cth electrode 51C and 5-1Eth electrode 51E, and the passing apertures 24R, 26R of the red electron beam R are deviated by $d_2$ downwardly. On the other hand, in the center 5-1Dth electrode 51D, the passing aperture 25B of the blue electron beam B is deviated by $d_2$ downwardly, and the passing aperture 25R of the red electron beam R is deviated by $d_2$ upwardly.

Here, in the convergence correction principle, similar to the above-mentioned principle, since the electron beam passing apertures 23B, 24B, 25B and 23R, 24R, 25R of the respective electrodes 51C, 51D, 51E are deviated, the application direction of the electric field is displaced and the beam orbit is changed (see FIG. 32).

In the adjustment in the vertical direction, an action-similar to that of the adjustment in the horizontal direction shown in FIG. 8 occurs so that the three electron beams R, G, B may be converged even at the peripheral portions of the fluorescent screen 4.

The shapes of the two outside electron beam passing apertures of the electrodes 51A, 51B, 51C comprising the first lens L1 or the electrodes 51C, 51D, 51E comprising the second lens L2 may be oblong ellipse, ellipse or true circle. Then, so long as a relationship between pitches of passing apertures or a relationship between the upward and downward deviations of the passing apertures is the above-mentioned relationship, the convergence in the horizontal direction and the vertical direction may be adjusted.

Also, when the polarity of the waveform of FIG. 30 is inverted, a relationship between the upward and downward deviations of the respective electron beam passing apertures becomes, as shown in FIG. 31B, opposite to that of FIG. 31A.

Figure 8B:
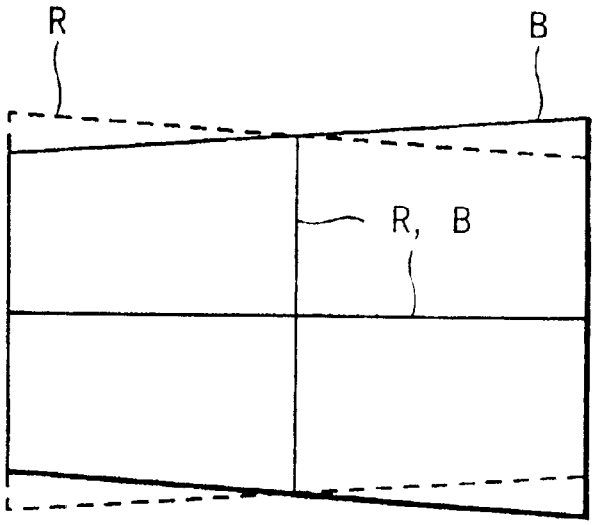
FIG. 8B PRIOR ART
FIG. 8B is a diagram showing a vertical direction mis-convergence.

Incidentally, depending upon the design of the deflection yoke, the mis-convergence pattern in the vertical direction does not always become the shape of FIG. 8B.

In that case, if the electron beam passing apertures are shaped as shown in FIG. 31A or 31B and a voltage of an arbitrary waveform is applied to the 5-1Dth electrode 51D, then the mis-convergence in the vertical direction may be adjusted.

Incidentally, while both of the deviation amounts of the passing apertures of the outside electron beams R, G are equal to $d_2$ in FIGS. 31A and 31B, depending upon the mis-convergence state, the deviation amount d' in the center electrode 51D may be made different from the deviation amounts $d_2$ in the outside electrodes 51C, 51E.

Also in this case, the deviation amount of the passing aperture of the red electron beam R in the same electrode and the deviation amount of the passing aperture of the blue electron beam B may be the same.

Also, the horizontal direction convergence adjustment lens and the vertical direction convergence adjustment leans may be arranged in the opposite order.

That is, the first lens (uni-potential lens) L1 composed of the 5-1Ath electrode 51A, the 5-1Bth electrode 51B, the 5-1Cth electrode 51X may be used as the vertical direction convergence adjustment lens, and the second lens (uni-potential lens) L2 composed of the 5-1Cth electrode 51C, the 5-1Dth electrode 51D, the 5-1Eth electrode 51E may be used as the horizontal direction convergence adjustment lens.

According to the above-mentioned embodiment, by adjusting the convergences in the horizontal direction and the vertical direction, the three electron beams R, G, B may have satisfactory convergence characteristics and satisfactory shapes on the whole region of the screen, thereby suppressing the focus from being deteriorated at the peripheral portions of the screen.

Also, since the convergence is adjusted by an electrostatic lens using an electrode and a waveform voltage, power consumption may be decreased as compared with a method using a magnetic field such as an adjustment method using an electromagnetic coil. Further, as compared with the method using the electromagnetic coil, a phase difference caused by an eddy current is never caused so that the above-mentioned cathode-ray tube electron gun may be applied to a high-frequency cathode-ray tube.

Figure 34:
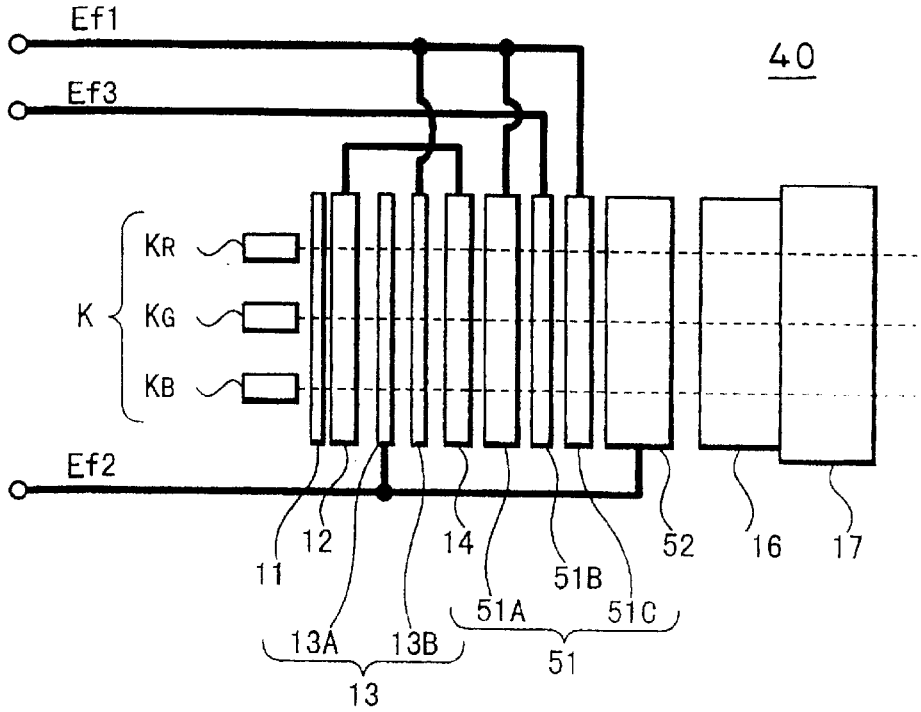
FIG. 34 is a schematic diagram showing an electrode layout of a electron gun according to another embodiment of the present invention.

While the first lens, the second lens and the two uni-potential lenses are arranged by dividing the fifth electrode by five in the above-mentioned embodiment, the present invention may also be applied to a case in which one uni-potential lens is arranged by dividing the fifth electrode by three. FIG. 34 shows an electrode layout obtained in that case.

Figure 6:
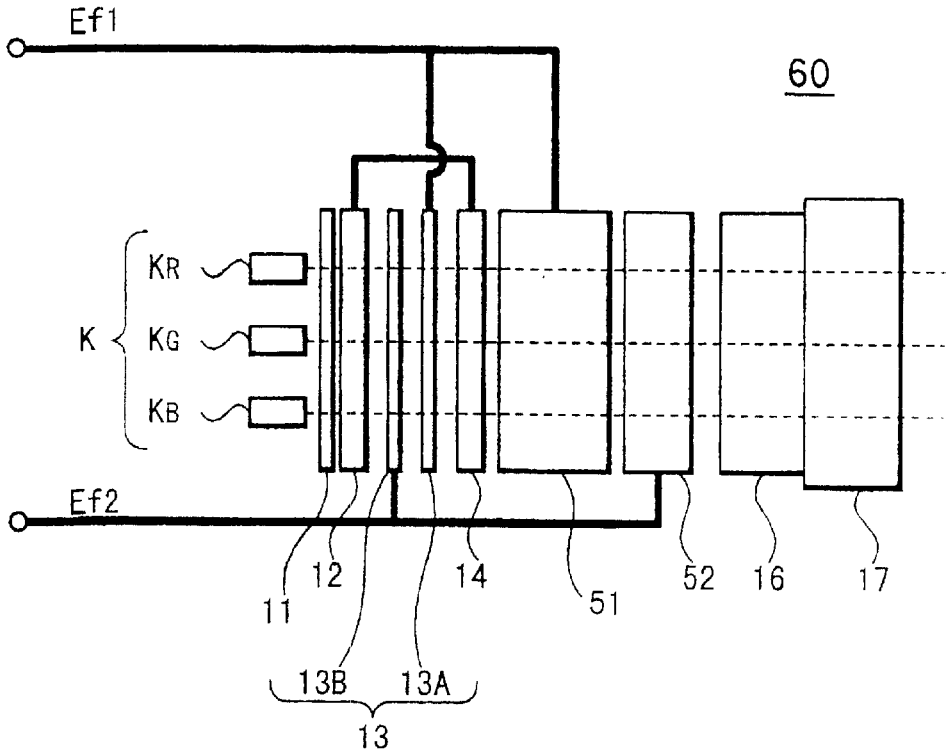
FIG. 6 PRIOR ART
FIG. 6 is a schematic diagram showing an example of a color cathode-ray tube electron gun housing a quadrupole lens according to the prior art.

A color cathode-ray tube electron gun 40 shown in FIG. 34 is different from the conventional electron gun 60 shown in FIG. 6 in that the 5-1th electrode 51 is trisected to provide the 5-1Ath electrode 51A, the 5-1Bth electrode 51B, the 5-1th electrode 51C and these three electrodes 51A, 51B, 51C constitute one uni-potential lens.

The constant focusing voltage (fixed focusing voltage) Ef1 is applied to the two outside electrodes 51A, 51C of the trisected 5-1th electrode 51 similarly to the third electrode 13B, and the third focusing voltage Ef3 is applied to the center electrode 51B.

As the third focusing voltage Ef3, there may be used a waveform voltage similar to that of the preceding embodiment shown in FIG. 28.

Thus, the convergence arrangement in the horizontal direction may be made.

Also, the electron beam passing apertures may be arranged similarly to those of the preceding embodiment shown in FIG. 29A.

The rest of this arrangement such as the second focusing voltage Ef2 or the like is similar to that of the conventional electron gun 60 shown in FIG. 6.

Incidentally, in the electron gun 40 shown in FIG. 34, when the convergence in the vertical direction is adjusted instead of the adjustment of the convergence in the horizontal direction, a waveform voltage similar to the fourth focusing voltage Ef4 shown in FIG. 30 and the arrangements of the electron beam passing apertures shown in FIG. 31A may be adopted.

When the 5-1th electrode 51 is trisected, in the lens comprised of the trisected electrodes, the convergence in either the horizontal direction or the vertical direction may be adjusted.

In this case, the convergence in the remaining direction is adjust by the deflection yoke.

Figure 35:
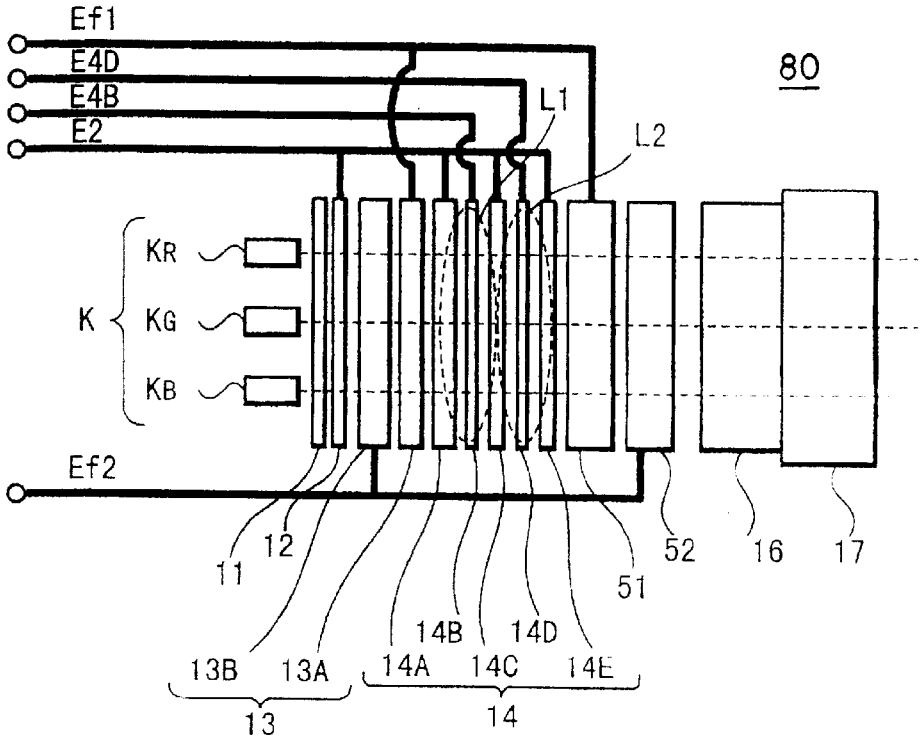
FIG. 35 is a schematic diagram showing an electrode layout of an electron gun according to a further embodiment of the present invention.

Also, as a further embodiment, instead of the case in which the 5-1th electrode is divided by five (or three), the fourth electrode may be divided by five (or three). FIG. 35 shows an electrode layout obtained in that case.

A color cathode-ray tube electron gun 80 shown in FIG. 35 includes three cathodes $K_R$, $K_G$, $K_B$ that are parallelly arrayed in an inline fashion. From the cathodes K ($K_R$, $K_G$, $K_B$) to the anode side, there are coaxially disposed a first electrode 11, a second electrode 12, a third electrode 13, a fourth electrode 14, a fifth electrode 51, 52, a sixth electrode 16, a shield ca 17, in that order. The second electrode 12 and the fourth electrode 14 are electrically connected.

The third electrode 13 and the fifth electrode 51, 52 are convergence electrodes (focusing electrodes), and held at a potential ranging from 4kV to 10kV.

Also, the sixth electrode is an acceleration electrode, and held at a potential ranging from 20kV to 30kV.

A pre-focusing lens is arranged between the cathodes K and the third electrode 13, a first convergence lens (focusing lens) is arranged between the third electrode 13 and the fifth electrode 51, 52, and a main convergence lens is arranged between the fifth electrode 51, 52 and the sixth electrode 16.

Then, the third electrode 13 is divided to provide a 3Ath electrode 13A and 3Bth electrode 13B, and the fifth electrode is divided by half to provide a 5-1th electrode 51 and a 5-2th electrode 52.

Further, in the embodiment of the present invention, the fourth electrode 14, in particular, is divided by dive to form a 4Ath electrode 14A, a 4Bth electrode 14B, a 4Cth electrode 14C, a 4Dth electrode 14D, a 4Eth electrode 14E from the cathode side.

Then, of these five electrodes, the three electrodes 14A, 14B, 14C on the cathode side constitute a first lens (uni-potential lens) L1, and the three electrodes 14C, 14D, 14E on the anode side constitute a second lens (uni-potential lens) L2.

A constant first focusing voltage (fixed focusing voltage) Ef1 is applied through a stem portion to the 3Ath electrode 13A on the anode side of the third electrode 13 and the 5-1th electrode 51.

Figure 27:
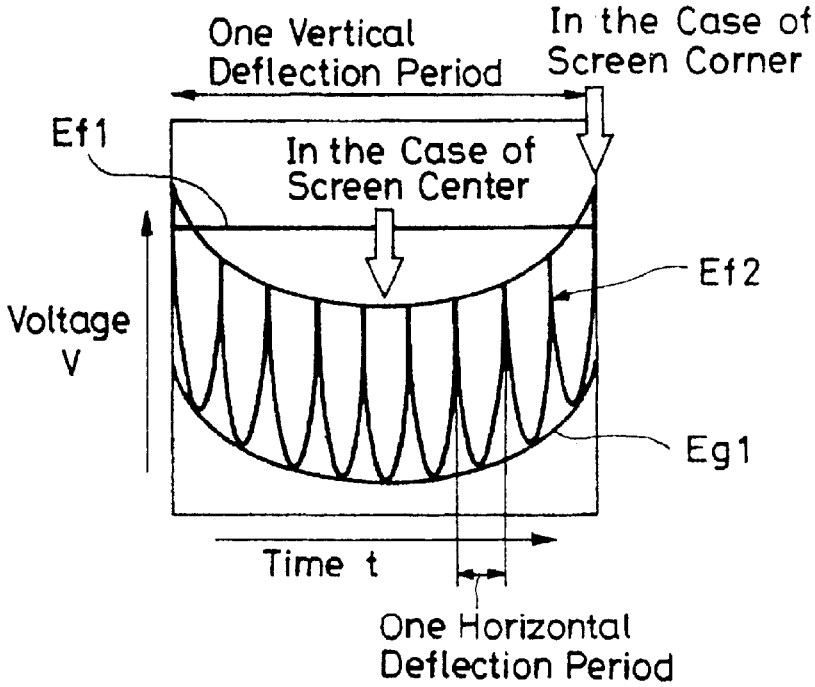
FIG. 27 is a diagram showing waveforms of first and second focusing voltages used in the electron gun of FIG. 26.

On the other hand, a second focusing voltage Ef2 similar to the waveform voltages shown in FIGS. 27 and 7 is applied to the 3Bth electrode 13B on the cathode side of the third electrode 13 and the 5-2th electrode 52.

Then, a constant (e.g. 500V) second electrode voltage E2 is applied to the second electrode 12 and the outside electrodes 14A, 14C, 14E in the three electrodes 14A, 14B, 14C constituting the first lens L1 and in the three electrodes 14C, 14D, 14E constituting the second lens L2 of the fourth electrode 14 divided by five.

Further, a 4Bth electrode voltage E4V of a waveform similar to that of the third focusing voltage Ef3 shown in FIG. 28 is applied to the center electrode 14B of the three electrodes 14A, 14B, 14C constituting the first lens L1 in the fourth electrode 14.

The 4Bth electrode voltage E4B becomes a voltage in which a value of a voltage is smaller than that of the third focusing voltage Ef3 of FIG. 28 and a waveform voltage of a waveform similar to that of FIG. 28 is superimposed upon the second electrode voltage E2 (e.g. 500V).

As described above, by applying the 4Bth electrode voltage E4B to the 4Bth electrode 14B, the lens effect of the first lens L1 may be adjusted and the convergence in the horizontal direction of the three electron beams R, G, B may be adjusted on the whole surface of the screen.

Incidentally, in the 4Ath electrode 14A, the 4Bth electrode 14V, the 4Cth electrode 14C, the opening portions of the electronbeam passing apertures on the opposing surfaces thereof may be shaped as shown in FIG. 29A.

On the other hand, a 4Dth electrode voltage E4D of a waveform similar to that of the fourth focusing voltage Ef4 shown in FIG. 30 is applied to the center electrode 14D of the three electrodes 14C, 14D, 14E constituting the second lens L2 of the fourth electrode 14.

However, this 4Dth electrode voltage E4D becomes a voltage in which a value of a voltage is smaller than that of the fourth focusing voltage Ef4 of FIG. 30 and a waveform voltage of a waveform similar to that of FIG. 30 is superimposed upon the second electrode voltage E2 (e.g. 500V).

As described above, by applying the 4Dth electrode voltage E4D to the 4Dth electrode 14D, the lens effect of the second lens L2 may be adjusted, and the convergence in the vertical direction of the three electron beams R, G, B may be adjusted on the whole surface of the screen. Incidentally, in the 4Cth electrode 14C, the 4Dth electrode 14D, the 4Eth electrode 14E, the opening portions of the electron beam passing apertures on the opposing surfaces thereof may be shaped as shown in FIG. 31A.

Since the electron gun 80 according to this embodiment is arranged as described above, similarly to the electron gun 30 shown in the preceding embodiment, the convergence in the horizontal and vertical directions may be adjusted.

The color cathode-ray tube electron gun according to the present invention is not limited to the above-mentioned embodiments, and may be variously modified without departing from the spirit of the present invention.

According to the above-mentioned arrangement of the present invention, since the voltage of the waveform similar to the sawtooth synchronized with the horizontal scanning is applied to the center focusing electrode of the trisected focusing electrodes and the voltage which results from passing the voltage of the waveform similar to the sawtooth through the housed resistor is applied to the two outside focusing electrodes, the difference between the focusing voltages applied to the two outside electron beams may be decreased so that the three electron beams of the satisfactory shapes may be simultaneously obtained on the whole region of the screen.

As a result, it is possible to reliably avoid the disadvantage that red characters become unclear on the right-hand side of the florescent screen and blue characters become unclear on the left-hand side of the fluorescent screen. In addition, it is possible to obtain beam spots of satisfactory shapes over the whole of the fluorescent screen.

Also, since the kinds of focusing voltages that should be adjusted are reduced, a process for such adjustment may be simplified.

Also, when the three electron beam passing apertures of the trisected focusing electrodes are formed as different electrode thickness in the outside electron beam passing apertures of the opposing focusing electrodes and the two outside electron beam passing apertures of the same focusing electrode are formed as different astigmatic shapes or different diameters of different electrode thickness, the deflection magnetic fields acting on the three electron beams may be independently controlled at the respective electron beams. Thus, the three electron beams of the satisfactory shapes may be obtained as the peripheral portions of the screen simultaneously.

Also, when the above-mentioned voltage of the sawtooth waveform is decreased in the direction from the position of the red color to the position of the blue color on the fluorescent screen of the cathode-ray tube, the focusing of the red electron beam whose deterioration is noticeable may be improved, and the whole resolutionmay be well-balanced.

Further, according to the present invention, since the center electrodes form the quadrupole lens and the convergence lens, respectively, both of the quadrupole component and the convergence lens component of the focus deterioration of the red electron beam and the blue electron beam on the peripheral portions of the screen may be corrected with a sufficient sensitivity without affecting the lens structure of the electron gun.

According to the above-mentioned color cathode-ray tube electron gun according to the present invention, the convergence in the horizontal direction may be adjusted and the convergence in the vertical direction may be adjusted. Hence, satisfactory convergence characteristics of three electron beams may be obtained on the whole region of the screen.

Also, on the peripheral portions of the screen, it is possible to alleviate the focus from being deteriorated due to the distortion of the deflection.

Also, according to the present invention, as compared with the convergence adjustment method using the magnetic field, the convergence is adjusted by the electrostatic lens, and hence a power consumption may be decreased.

Further, as compared with a method using an electromagnetic coil, a phase difference caused by an eddy current or the like does not occur, and hence the present invention may be applied to a high-frequency cathode-ray tube.

When the electrode is divided by five and voltages of different waveforms synchronized with the deflection in the horizontal direction and the deflection in the vertical direction are applied to the center electrode of the three electrodes on the cathode side and the center electrode of the three electrodes on the anode side, the convergence in the horizontal direction may be adjusted by a lens composed of one three electrodes, and the convergence in the vertical direction may be adjusted by a lens composed of the other three electrodes.

That is, the convergence in the horizontal and vertical directions may be adjusted by the electrodes divided by five.

Also, when the outside electron beam passing apertures of the center electrode and the two outside electrodes in the trisected electrodes are deviated from each other in the opposite direction in the horizontal direction or the vertical direction, the orbit of the outside electron beam may be changed, and the convergence may be adjusted in the deviated direction, i.e. the horizontal direction or the vertical direction.

Having described preferred embodiments of the present invention with reference to the accompanying drawings, it is to be understood that the present invention is not limited to the above-mentioned embodiments and that various changes and modifications can be effected therein by one skilled in the art without departing from the spirit or scope of the present invention as defined in the appended claims.

What is claimed is:

1. A color cathode-ray tube electron gun, comprising:

at least one trisected focusing electrode, a first voltage of a waveform similar to a sawtooth synchronized with a horizontal scanning being applied to a center focusing electrode of said at least one trisected focusing electrode, a housed resistor connected to said center focusing electrode, and a voltage resulting from passing said first voltage through said housed resistor being applied to two outside electrodes of said at least one trisected focusing electrode.

2. A color cathode-ray tube electron gun according to claim 1, further comprising a second focusing electrode provided independently of said at least one trisected focusing electrode and a third voltage of a waveform with a parabolic shape synchronized with said horizontal scanning which is applied to said second focusing electrode.

3. A color cathode-ray tube electron gun according to claim 1, wherein said at least one trisected focusing electrode comprises apertures through which outside electron beams of a set of three electron beams pass, wherein at least one of said apertures is formed with a horizontally-oblong astigmatic shape and at least one of said apertures is formed with a vertically-oblong astigmatic shape such that one of said outside electron beams passes through an aperture with said horizontally-oblong astigmatic shape and through an aperture with said vertically-oblong astigmatic shape.

4. A color cathode-ray tube electron gun as claimed in claim 1, wherein said at least one trisected focusing electrode comprises apertures through which outside electron beams of a set of three electron beams pass, wherein at least one of said apertures is made with a first diameter and at least one of said apertures is made with a second diameter, said second diameter being smaller than said first diameter such that each of said outside electron beams passes through a first of said apertures having said first diameter and a second of said apertures having said second diameter.

5. A color cathode-ray tube electron gun as claimed in claim 1, wherein said at least one trisected focusing electrode comprises a plurality of electrodes, wherein each of said plurality of electrodes comprises at least one first portion having a first thickness and at least one second portion having a second thickness, wherein said second thickness is less than said first thickness, said at least one trisected focusing electrode further comprising a plurality of apertures such that outside electron beams of a set of three electron beams pass through a first of said apertures formed in a first portion having said first thickness and a second of said apertures formed in a second portion having said second thickness.

6. A color cathode-ray tube electron gun as claimed in claim 1, characterized in that said voltage of the sawtooth waveform decreased in a direction from a position of red color to a position of blue color on a fluorescent screen of a cathode-ray tube.

7. A color cathode-ray tube electron gun, comprising:

a trisected electrode, and a fixed voltage which is applied to two outside electrodes of said trisected electrode and a voltage of a waveform similar to a sawtooth synchronized with horizontal scanning which is applied to a center electrode of said trisected electrode, wherein said center electrode and at first outside electrode of said trisected electrode form a quadrupole lens, and wherein said center electrode and a second outside electrode of said trisected electrode form a convergence lens.

8. A color cathode-ray tube electron gun according to claim 7, wherein said center electrode and said first outside electrode forming said quadrupole lens further comprise apertures through which outside electron beams of a set of three electron beams pass, wherein at least one of said apertures is formed with a horizontally-oblong astigmatic shape and at least one of said apertures is formed with a vertically-oblong astigmatic shape such that at least one of said outside electron beams passes through an aperture with said horizontally-oblong astigmatic shape and through an aperture with said vertically-oblong astigmatic shape.

9. A color cathode-ray tube electron gun as claimed in claim 7, wherein said center electrode and said second outside electrode forming said convergence lens further comprise apertures through which outside electron beams of a set of three electron beams pass, wherein at least one of said apertures is made with a first diameter and at least one of said apertures is made with a second diameter, said second diameter being smaller than said first diameter such that each of said outside electron beams passes through a first of said apertures having said first diameter and a second of said apertures having said second diameter.

10. A color cathode-ray tube electron gun as claimed in claim 7, wherein said center electrode and said second outside electrode forming said convergence lens each comprise at least one first portion having a first thickness and at least one second portion having a second thickness, wherein said second thickness is less than said first thickness, said at center and second outside electrodes further comprise a plurality of aperture such that outside electron beams of a set of three electron beams pass through a first of said apertures formed in a first portion having said first thickness and a second of said apertures formed in a second portion having said second thickness.

11. A color cathode-ray tube electron gun comprising:

a trisected electrode forming a first uni-potential lens, and a voltage of a waveform synchronized with a horizontal direction deflection signal and a vertical direction deflection signal which is applied to a center electrode of said trisected electrode.

12. A color cathode-ray tube electron gun according to claim 11, wherein said trisected electrode is part of an electrode divided into five sub-electrodes, wherein of electrode divided by five, three sub-electrodes on a cathode side are said trisected electrode and three electrodes on an anode side constitute a second trisected electrode which forms a second a uni-potential lens.

13. A color cathode-ray tube electron gun according to claim 11, wherein said trisected electrode is a focusing electrode for focusing electron beams.

14. A color cathode-ray tube electron gun as claimed in claim 12, wherein voltages of different waveforms synchronized with a horizontal direction deflection signal and a vertical direction deflection signal are applied to a center electrode of each of said trisected electrodes.

15. A color cathode-ray tube electron gun as claimed in claim 11, wherein said waveforms synchronized with said horizontal direction deflection signal and said vertical direction deflection signal are waveforms with parabolic shapes at every horizontal direction deflection period.

16. A color cathode-ray tube electron gun as claimed in claim 11, wherein said trisected electrodes comprise electron beam passing apertures wherein at least two apertures in successive sub-electrodes through which an electron beam passes are offset relative to each other by a predetermined amount in opposite directions along a horizontal direction.

17. A color cathode-ray tube electron gun as claimed in claim 11, wherein said trisected electrodes comprise electron beam passing apertures wherein at least two apertures in successive sub-electrodes through which an electron beam passes are offset relative to each other by a predetermined amount in opposite directions along a vertical direction.

18. A method of converging three electron beams, each representing a different color, on a fluorescent screen of a cathode ray tube, the method comprising:

passing each of said three beams through a different portion of an electro-magnetic field, wherein a dimension of electrodes of an electron gun and a signal voltage applied thereto are determined such that an error in the convergence of said respective beams is corrected by passage through said eletro-magnetic field.

19. The method of claim 18, further comprising creating said electro-magnetic field with a series of electrodes having apertures for passing said electron beams formed therein.

* * * * *

UNITED STATES PATENT AND TRADEMARK OFFICE

CERTIFICATE OF CORRECTION

PATENT NO. : 6,597,096 B1
DATED : May 20, 2003
INVENTOR(S) : Masaaki Oka et al.

It is certified that error appears in the above-identified patent and that said Letters Patent is hereby corrected as shown below:

Title page,
Item [73], Assignee, insert: -- Kabushiki Kaisha Toshiba (JP) --

Signed and Sealed this

Twentieth Day of January, 2004

JON W. DUDAS
*Acting Director of the United States Patent and Trademark Office*